US006679595B2

(12) United States Patent
Yamada et al.

(10) Patent No.: US 6,679,595 B2
(45) Date of Patent: Jan. 20, 2004

(54) INK JET RECORDING APPARATUS

(75) Inventors: Takahiro Yamada, Toyoake (JP); Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/058,129

(22) Filed: Jan. 29, 2002

(65) Prior Publication Data

US 2002/0105567 A1 Aug. 8, 2002

(30) Foreign Application Priority Data

| | | |
|---|---|---|
| Feb. 8, 2001 | (JP) | 2001-032333 |
| Feb. 8, 2001 | (JP) | 2001-032334 |
| Feb. 21, 2001 | (JP) | 2001-044805 |
| Mar. 21, 2001 | (JP) | 2001-081546 |

(51) Int. Cl.[7] ..... B41J 2/14
(52) U.S. Cl. ..... 347/87; 347/20
(58) Field of Search ..... 347/20, 40, 65, 347/44, 47, 54, 87

(56) References Cited

U.S. PATENT DOCUMENTS

| | | | | |
|---|---|---|---|---|
| 4,994,825 A | | 2/1991 | Saito et al. | |
| 5,402,159 A | | 3/1995 | Takahashi et al. | |
| 5,563,641 A | * | 10/1996 | Plesinger | 347/47 |
| 5,874,971 A | | 2/1999 | Nishioka et al. | |
| 5,997,125 A | | 12/1999 | Nishioka et al. | |
| 6,079,810 A | | 6/2000 | Davis | |

FOREIGN PATENT DOCUMENTS

| | | |
|---|---|---|
| EP | 0 756 934 B1 | 2/1997 |

* cited by examiner

*Primary Examiner*—Anh T. N. Vo
(74) *Attorney, Agent, or Firm*—Oliff & Berridge, PLC

(57) ABSTRACT

An ink jet recording apparatus includes an ink jet head, a body frame, and a cover plate. The ink jet head has a plurality of nozzles that eject ink onto a recording medium, a plurality of pressure chambers provided in association with the nozzles, and a plurality of pressure generating portions that apply pressure to the pressure chambers so as to allow the ink to be ejected from the nozzles. The body frame communicates with an ink supply source and the ink jet head so as to supply the ink to the ink jet head. The cover plate has at least one window in a shape so as to enclose the nozzles. The cover plate is fixed to cover the ink jet head and fixed to the body frame. The ink jet recording apparatus further includes an inlet that communicates with an internal space formed between the body frame and the cover plate and an at least one outlet that communicates with the internal space. A filling material is supplied from the inlet and ejected to the at least one outlet.

28 Claims, 27 Drawing Sheets

INK JET RECORDING APPARATUS

BACKGROUND OF THE INVENTION

1. Field of Invention

The invention relates to an ink jet recording apparatus and a method for producing the same, and more particularly to an ink jet head unit and a method of producing the same.

2. Description of Related Art

An ink jet head recording apparatus performs printing by ejecting ink onto a sheet from nozzles provided in an ink jet head. The ink jet head includes a cavity plate having the nozzles, pressure chambers formed for the nozzles, and ink chambers, an actuator (a pressure generating portion) having driving elements associated with the pressure chambers, and a flexible flat cable sending an electrical signal to the actuator. The flexible flat cable, the actuator and the cavity plate are laminated one above the other.

The ink jet head communicates with an ink cartridge via ink supply passages formed in a body frame, and is adhesively secured to the body frame.

The ink jet head is covered with a cover plate so as to be protected against collision with recording sheets and to keep a connection between the actuator and the flexible flat cable free of foreign materials, such as ink and paper dust, to prevent an electrical short circuit from occurring. The cover plate is hermetically sealed around the ink jet head by the use of a sealer made of silicon. The cover plate has a window from which the nozzles protrude. The sealer is applied to the periphery of the window to prevent ink from spreading.

For example, U.S. Pat. No. 5,874,971 discloses an ink jet head that includes a nozzle case in which an ink jet head component having a nozzle is housed. The nozzle is connected to a cover head case. A groove is provided for forming a space between the ink jet head component and the cover head case. The nozzle case is provided with an adhesive injection opening to inject an adhesive from the injection opening into the groove. The area around the ink jet head is sealed by the adhesive and fastened to the case.

U.S. Pat. No. 4,994,825 discloses an ink jet head that includes an unevenly shaped groove or island at the bonding surface between the orifice plate and the head main body. The unevenly shaped groove or island buffers the stress generated due to curing shrinkage of the bonding agent or a difference in the thermal expansion coefficients between the respective constituent materials through the recessed portion constituting the space formed between the orifice plate and the head main body by the above uneven portion.

U.S. Pat. No. 6,079,810 discloses an ink jet head in which spaced circular holes, formed transversely through an orifice plate, and corresponding circular openings extending rearwardly into a body through its front end surface, are positioned in such that they are aligned with one another when the orifice plate is operatively secured to the front end of the body with adhesive, so that the holes and corresponding openings are filled with the adhesive.

It is desirable to increase a strength of bond in the above-described ink jet heads.

SUMMARY OF THE INVENTION

The invention provides an improved ink jet recording apparatus that comprises an ink jet head, a body frame, and a cover plate. The ink jet head has a plurality of nozzles that eject ink onto a recording medium, a plurality of pressure chambers provided in association with the nozzles, and a plurality of pressure generating portions that apply pressure to the pressure chambers so as to allow the ink to be ejected from the nozzles. The body frame communicates with an ink supply source and the ink jet head so as to supply the ink to the ink jet head. The cover plate has at least one window in a shape so as to enclose the nozzles. The cover plate is fixed to cover the ink jet head and fixed to the body frame. The ink jet recording apparatus further comprises an inlet that communicates with an internal space formed between the body frame and the cover plate and at least one outlet that communicates with the internal space. A filling material is supplied from the inlet and ejected to at least one outlet.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

A first embodiment of the invention will be described in detail with reference to the accompanying drawings.

Figure 1:
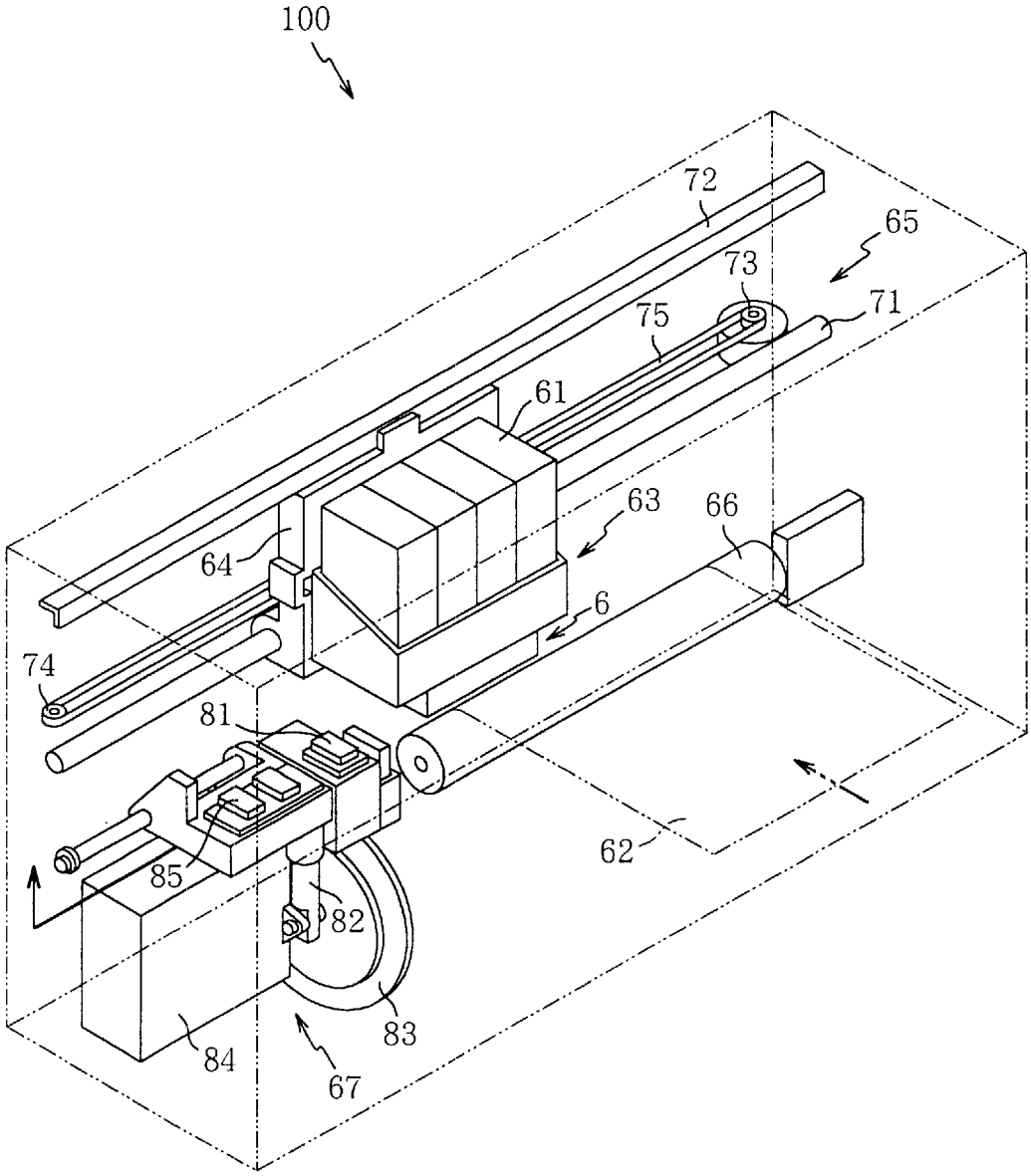
FIG. 1 is a perspective view of a color ink jet printer and an ink jet recording apparatus according to a first and second embodiments of the invention.

As shown in FIG. 1, a color ink jet printer 100 includes an ink cartridge 61, a head unit 63, a carriage 64, a driving unit 65, a platen roller 66, and a purging device 67. The ink cartridge 61 includes four different color inks, for example, cyan, magenta, yellow, and black. The head unit 63 has a piezoelectric ink jet head 6 for printing on a sheet 62. The ink cartridge 61 and the head unit 63 are loaded on the carriage 64, which is straightly reciprocated by the driving unit 65. The platen roller 66 is disposed in face-to-face relation with the piezoelectric ink jet head 6.

The driving unit 65 includes a carriage shaft 71, a guide plate 72, two pulleys 73 and 74, and an endless belt 75. The carriage shaft 71 is disposed at a lower end portion of the carriage 64 and extends in parallel with the platen roller 66. The guide plate 72 is disposed at an upper end portion of the carriage 64 and extends in parallel with the carriage shaft 71. The endless belt 75 is looped between the pulleys 73 and 74, which are disposed at both ends of the carriage shaft 71 between the carriage shaft 71 and the guide plate 72.

When a motor drives and one pulley 73 is rotated in a normal or opposite direction, the carriage 64 connected to the endless belt 75 is straightly reciprocated along the carriage shaft 71 and the guide plate 72.

The sheet 62 is supplied into the color ink jet printer 100 from a paper cassette (not shown) provided at a side of the ink jet printer 100, and fed between the piezoelectric ink jet head 6 and the platen roller 66, where printing is performed on the sheet 62 by the ink ejected from the piezoelectric ink jet head 6, and then ejected from the printer 100. In FIG. 1, a sheet feed mechanism and sheet eject mechanism are not shown.

The purging device 67 is provided on a side of the platen roller 66 and disposed so as to face the piezoelectric ink jet head 6 when the head unit 63 is in a reset position. The purging device 67 includes a purge cap 81 that is in contact with nozzle surface so as to cover nozzles of the piezoelectric ink jet head 6, a pump 82, a cam 83, and an ink restoring portion 84. When the head unit 63 is in the reset position, the nozzles of the piezoelectric ink jet head 6 are covered with the purge cap 81, deteriorated ink containing air bubbles accumulated inside the piezoelectric ink jet head 6 is sucked in by the pump 82, which is driven by the cam 83. By doing so, the piezoelectric ink jet head 6 is recovered. The sucked deteriorated ink is stored in the ink reservoir portion 84.

The cap 85 is used to cover the nozzles 22 of the piezoelectric ink jet head 6 mounted on the carriage 64 which returns to the reset position after printing is finished, so as to prevent the ink from being dried.

Figure 2:
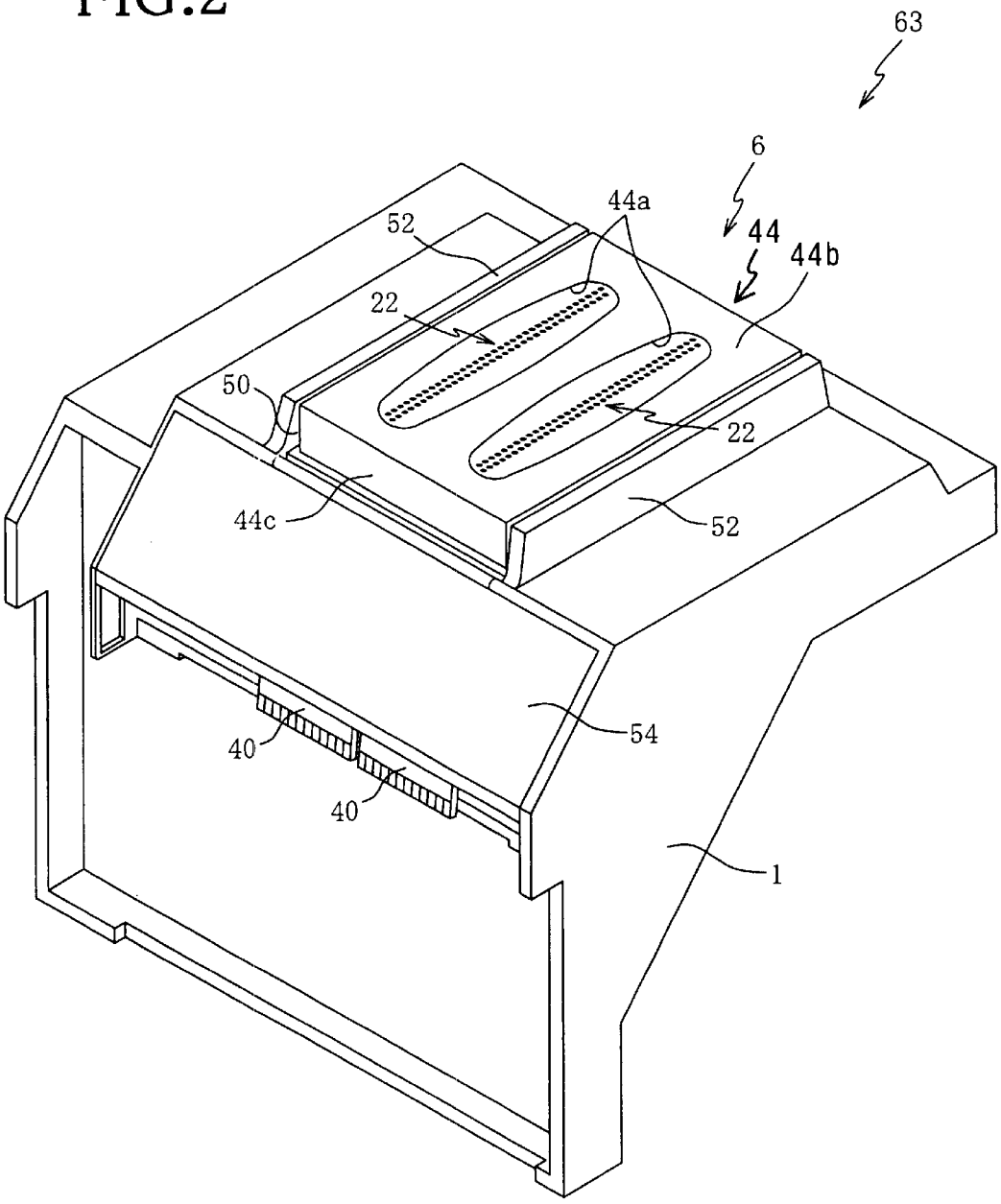
FIG. 2 is a perspective view of a head unit according to a first embodiment.
Figure 3:
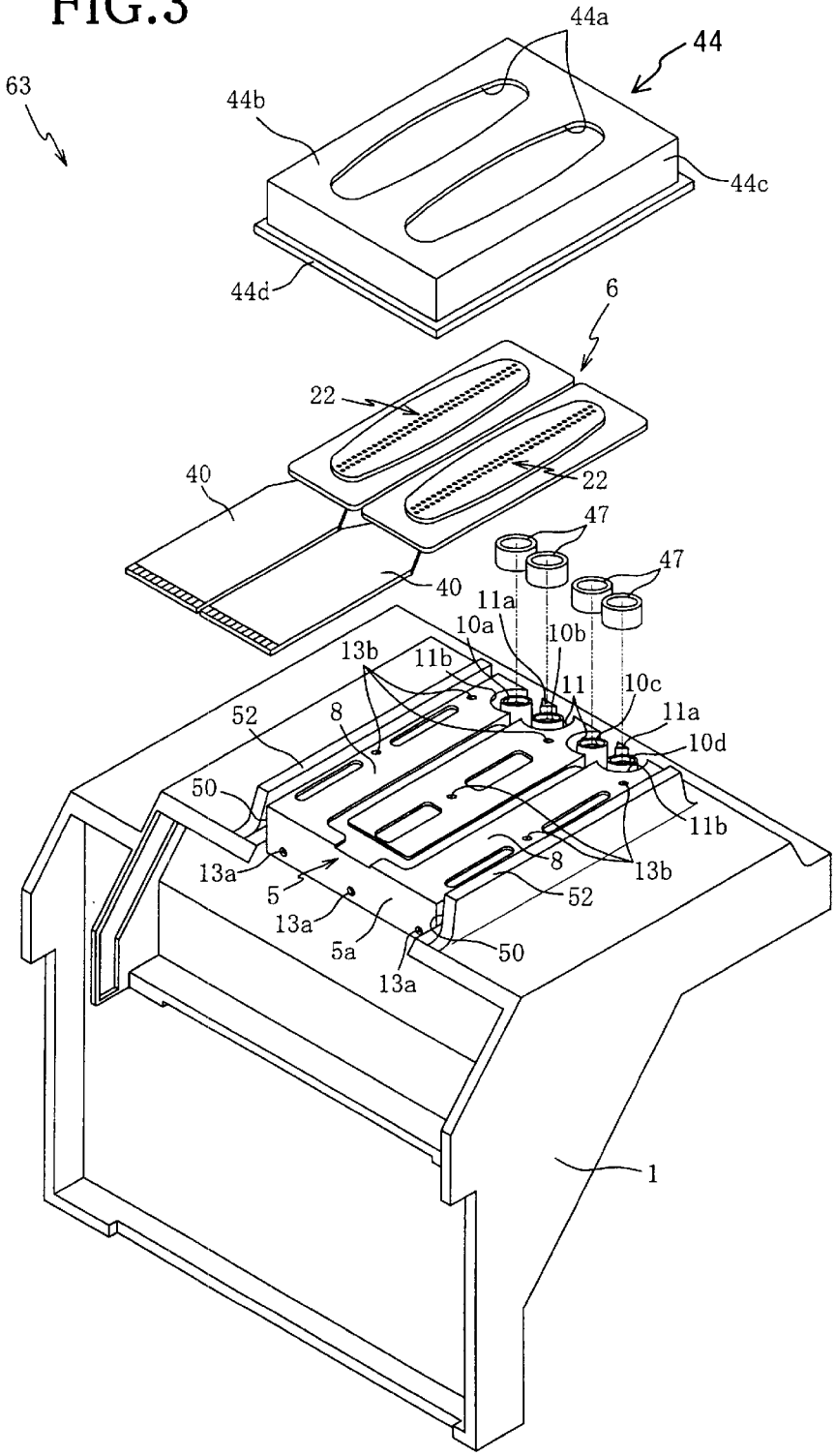
FIG. 3 is a perspective view of the head unit disassembled into structural parts according to the first embodiment.
Figure 4:
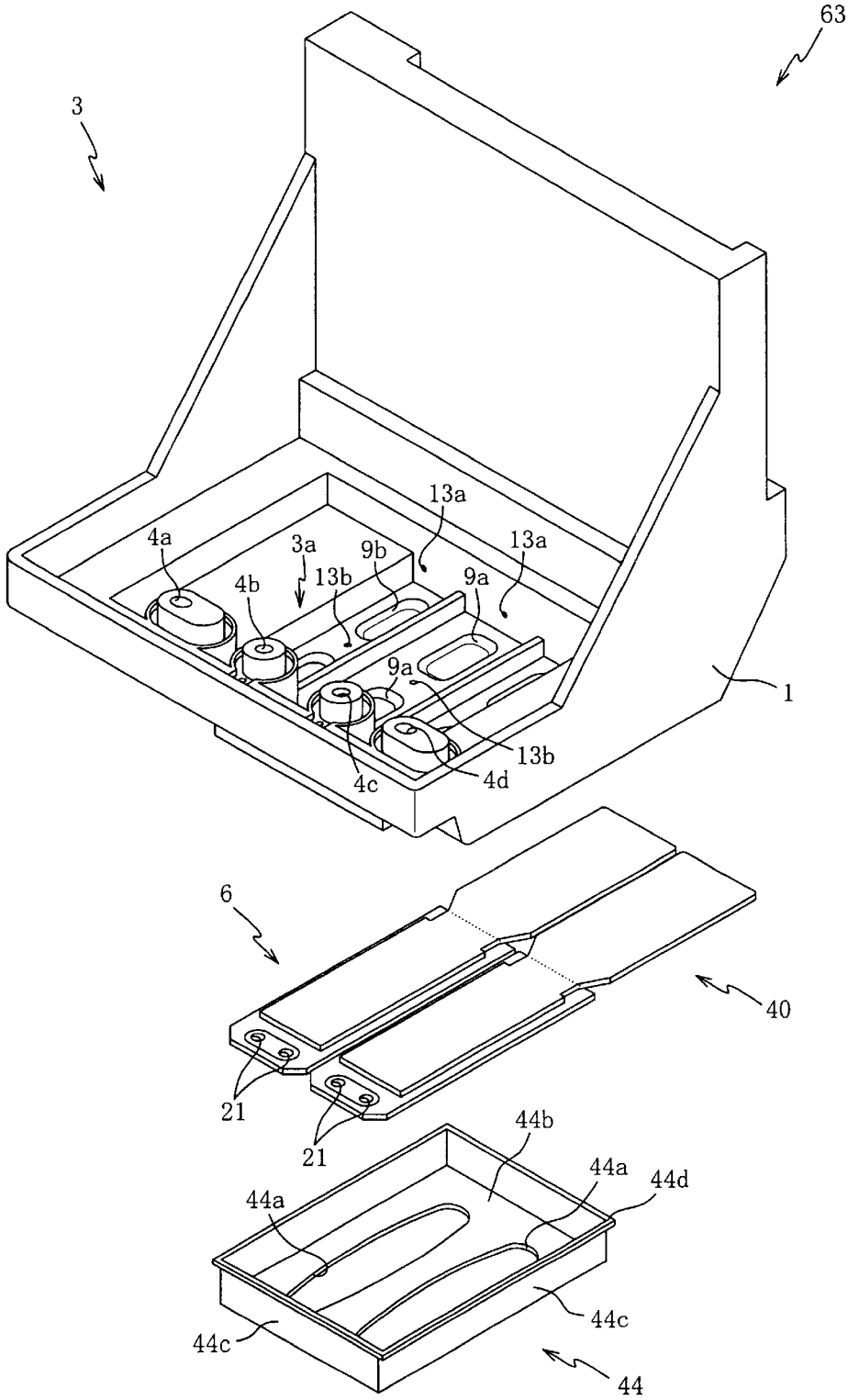
FIG. 4 is a perspective view of the head unit disassembled into structural parts according to the first embodiment.
Figure 5:
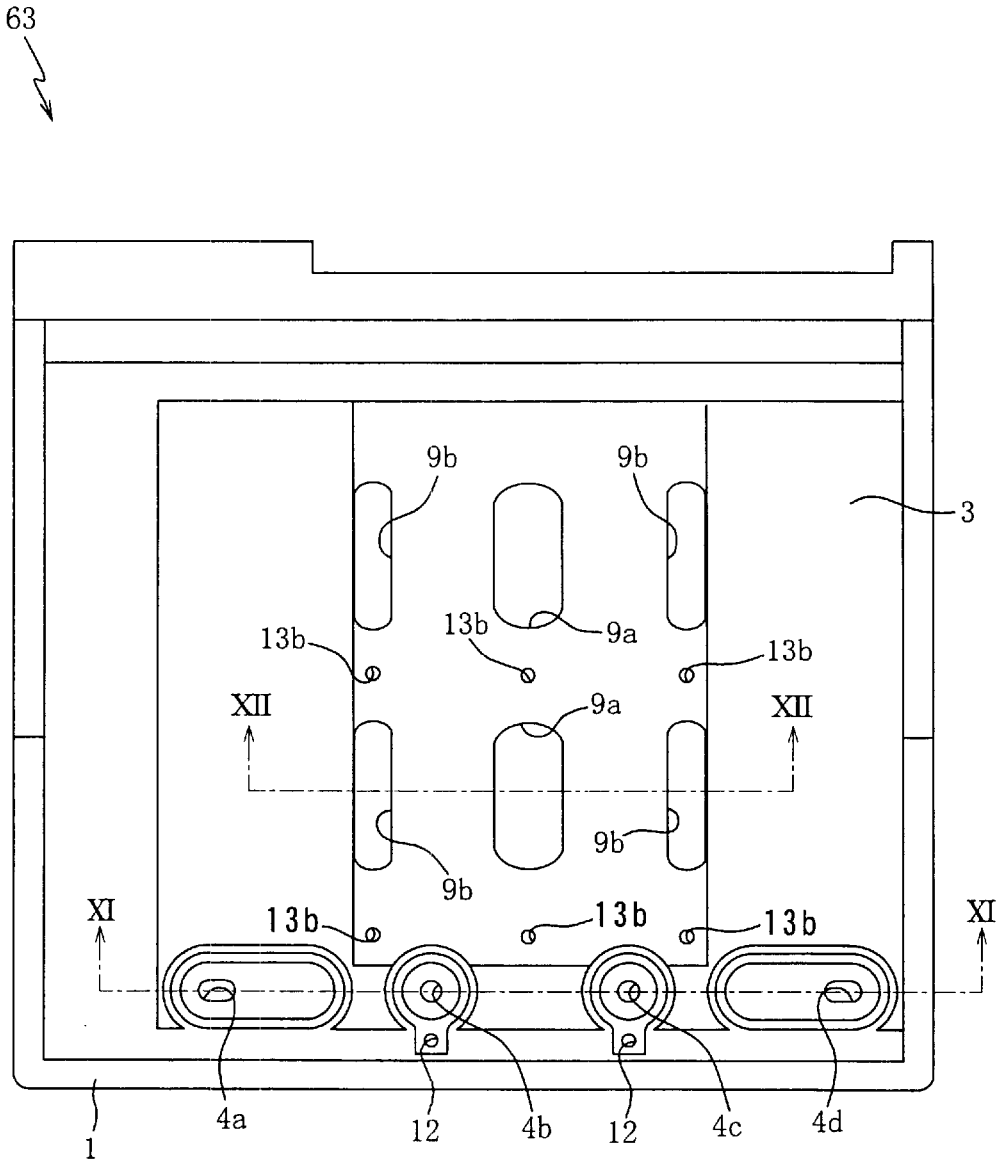
FIG. 5 is a top view of a body frame according to the first embodiment.
Figure 9:
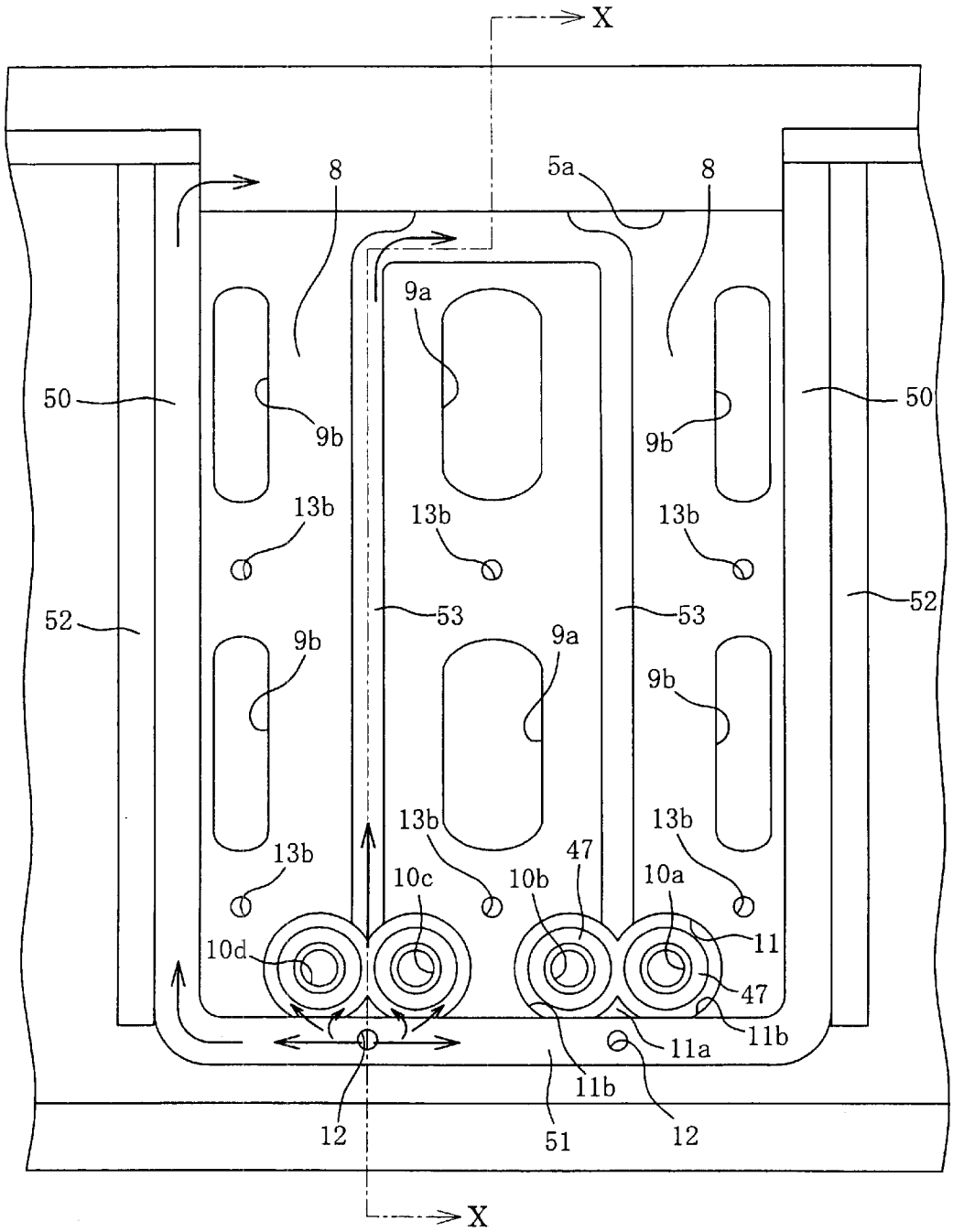
FIG. 9 is a bottom view of the body frame according to the first embodiment.

FIGS. 2, 3, and 4 are perspective views of the head unit 63. FIG. 5 is a top view of a body frame 1 of the head unit 63. FIG. 9 is a bottom view of the body frame 1 of the head unit 63. FIGS. 2 to 5, and 9 show the head unit 63 when the ink cartridge 61 is not attached. FIGS. 3 and 4 show the head unit 63 in an exploded view for easy understanding.

The body frame 1 mounted on the carriage 64 (FIG. 1) is an injection molded article and made of a synthetic resin such as polyethylene and polypropylene. The body frame 1 has a substantially box shape and an upper open structure (FIG. 4). The upper open structure is provided with an installation portion 3 to detachably attach the ink cartridge 61. Ink supply passages 4*a,* 4*b,* 4*c,* and 4*d,* which are connected to an ink discharging portion (not shown) of the ink cartridge 61 to be installed in the installation portion 3, are drilled through a side 3*a* of the installation portion 3. Each of the ink supply passages 4*a,* 4*b,* 4*c,* and 4*d* extends through to an undersurface of the body frame 1 where a bottom plate 5 (FIG. 3) is formed. Rubber packings (not shown) are disposed around each of the ink supply passages 4*a,* 4*b,* 4*c,* and 4*d* so as to fit with the ink discharging portion of the ink cartridge 61.

The bottom plate 5 is used to position the ink jet heads 6 and is formed horizontally so as to protrude from the body frame 1 (refer to FIG. 3). The bottom plate 5 has two supporting portions 8, where two piezoelectric ink jet heads 6 are arranged in parallel. The supporting portions 8 have holes 9*a,* 9*b,* where a UV adhesive 7 (FIG. 12) is supplied to secure the piezoelectric ink jet heads 6. The holes 9*a,* 9*b* continuing to the installation portion 3 are located so that one piezoelectric ink jet head 6 can be secured at four corners. In this embodiment, the holes 9*a* are widely formed in such a manner that each of the holes 9*a* spreads astride the two piezoelectric ink jet heads 6 arranged in parallel.

Connecting portions 10*a* to 10*d* that communicate with the ink cartridge 61 via the ink supply passages 4*a* to 4*d* are provided on one end of each of the supporting portions 8. Engagement grooves 11 formed in the shape of the numeral "8", in a plan view, are recessed around the connecting portions 10*a* to 10*d* (FIG. 9). Rubber ring-shape packings 47 are inserted into the engagement grooves 11. When the piezoelectric ink jet heads 6 are adhesively fixed to the body frame 1, the packings 47 are pressed so as to enclose ink supply ports 21 (FIG. 6) of the piezoelectric ink jet heads 6 at ends thereof, so that connections between the packings 47 and the ink supply ports 21 are hermetically sealed.

Figure 6:
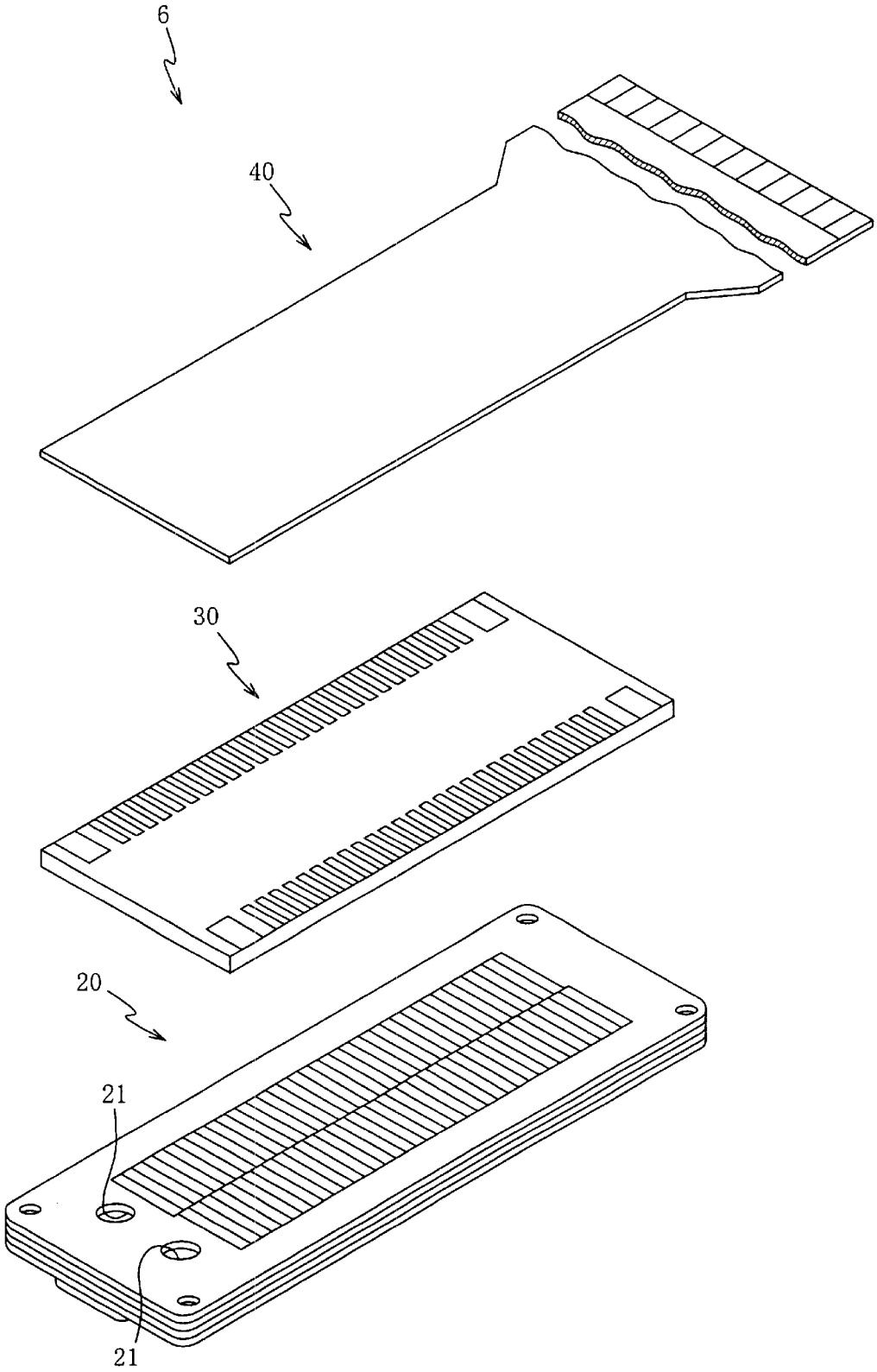
FIG. 6 is an exploded perspective view of a piezoelectric ink jet head according to the first embodiment.

FIG. 6 is an exploded perspective view of one piezoelectric ink jet head 6. The piezoelectric ink jet head 6 includes a multi-layered cavity plate 20, a plate-type piezoelectric actuator 30, and a flexible flat cable 40. The piezoelectric actuator 30 is adhered to the cavity plate 20 via an adhesive or an adhesive sheet (not shown), and the flexible flat cable 40 is bonded to the top of the piezoelectric actuator 30 for electrical connection with external equipment. Via the ink supply ports 21 provided at an upper surface of the cavity plate 20 (in FIG. 6), ink supplied from the ink cartridge 61 is downwardly discharged from the nozzles 22, opened toward a lower surface of the cavity plate 20.

Figure 7:
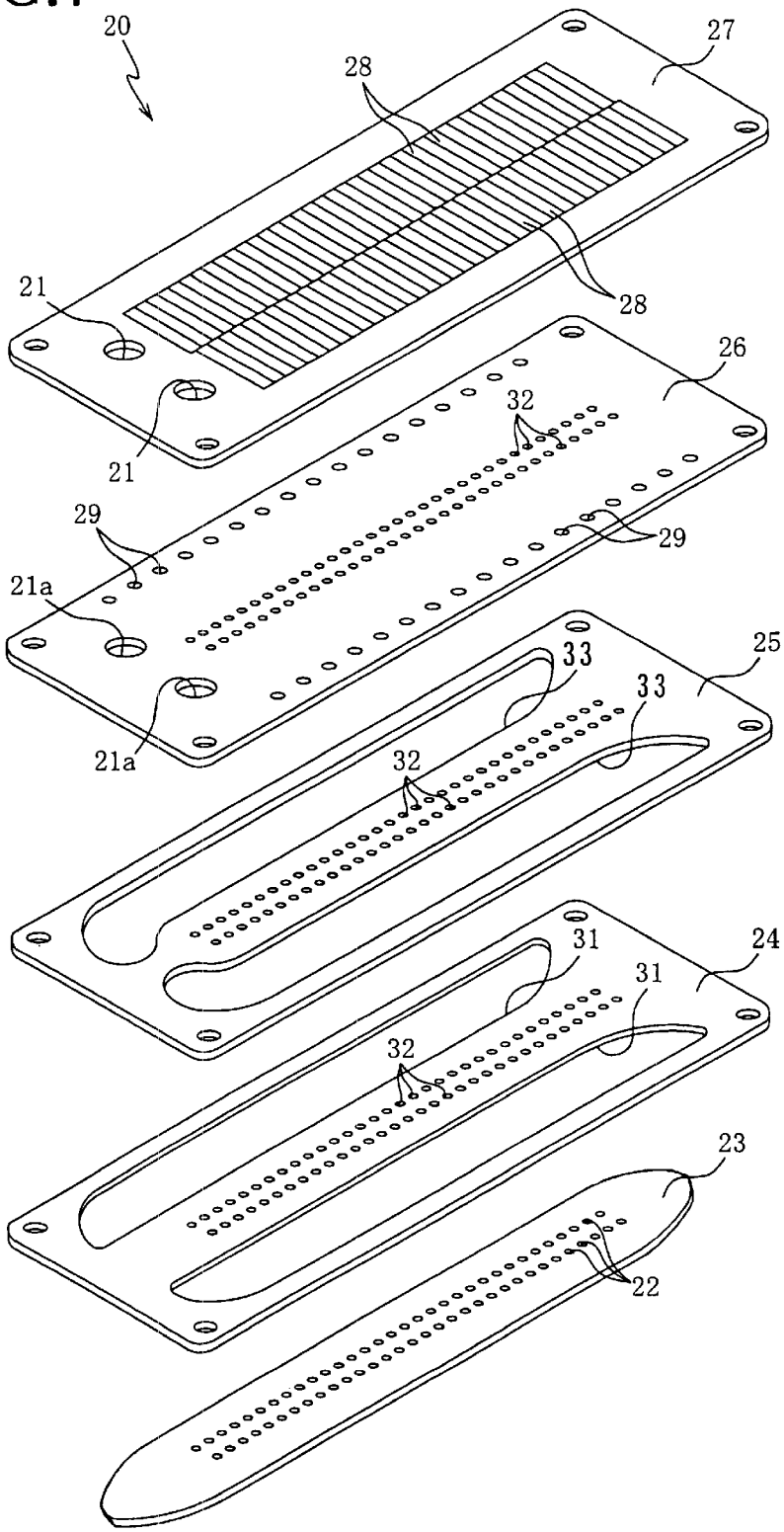
FIG. 7 is an exploded perspective view of a cavity plate according to the first embodiment.
Figure 8:
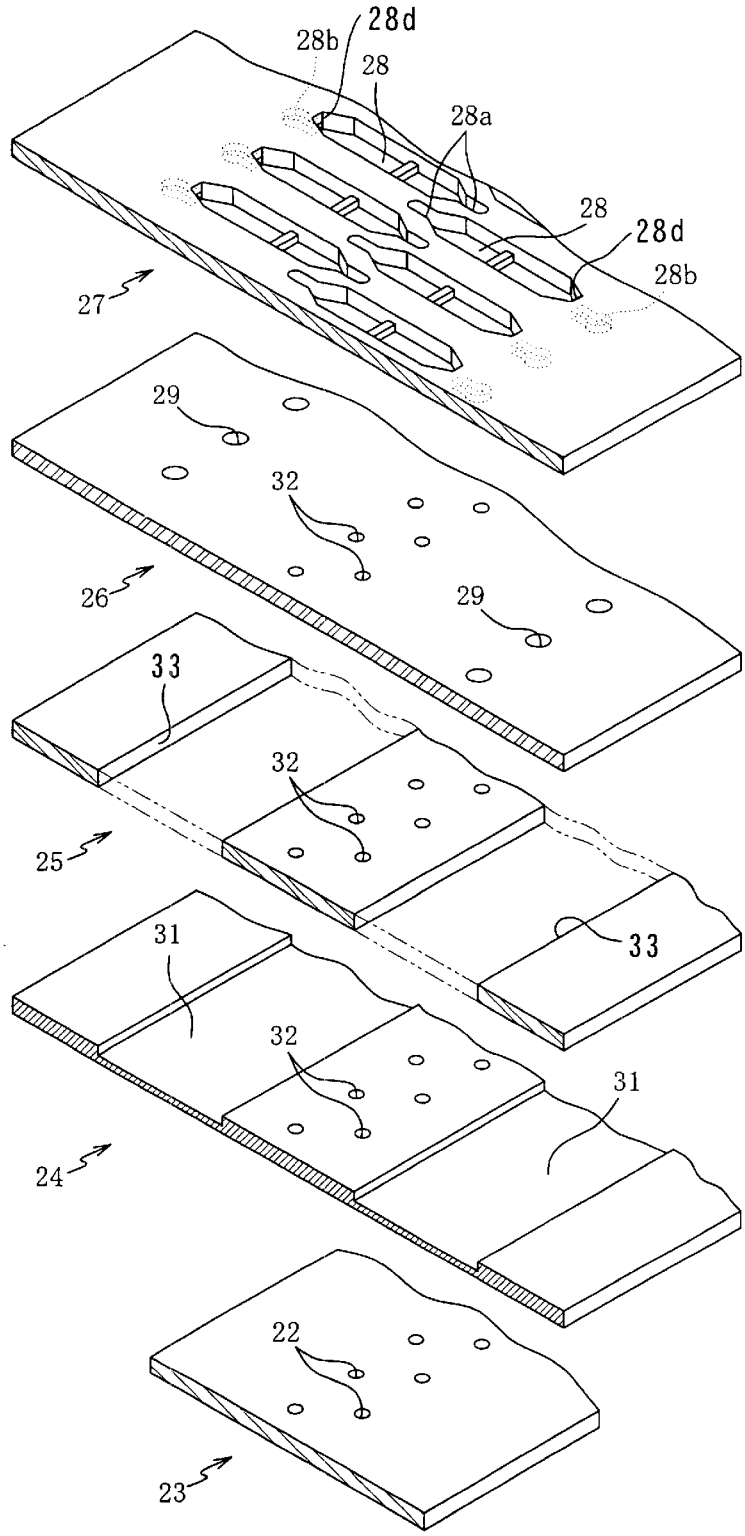
FIG. 8 is an enlarged exploded perspective view of a part of the cavity plate according to the first embodiment.

FIG. 7 is an exploded perspective view of the cavity plate 20. FIG. 8 is an exploded enlarged perspective view of the cavity plate 20. FIG. 8 shows the cavity plate 20 in a cross section cut in a direction orthogonal to a longitudinal direction of the cavity plate 20. As shown in FIG. 7, the cavity plate 20 includes five thin metal plates of substantially rectangular shape: a nozzle plate 23, two manifold plates 24, 25, a spacer plate 26, and a base plate 27, which are adhesively bonded to each other. In this embodiment, each plate 23 to 27 is made of steel alloyed with 42% nickel and has a thickness of 50 $\mu$m–150 $\mu$m. Each plate 23 to 27 is not limited to metal and may be made of other material such as resin.

As shown in FIG. 8, the base plate 27 is drilled to define two rows of staggered narrow pressure chambers 28 each of which extends in a direction orthogonal to a longitudinal direction of the base plate 27. Aperture portions 28*d* that are connected to the pressure chambers 28 and ink supply holes 28*b* that are connected to the aperture portions 28*d* are recessed in the base plate 27 at a side facing the spacer plate 26. The ink supply holes 28*b* communicate with the ink chambers 33 in the manifold plate 25 via corresponding ink supply holes 29 opened at opposite sides of the spacer plate 26. Narrow end portions 28*a* of the pressure chambers 28 communicate with nozzles 22 staggered in the nozzle plate 23 via through holes 32 having an extremely small diameter similarly staggered in the spacer plate 26 and the two manifold plates 24, 25.

As shown in FIG. 7, the base plate 27 and the spacer plate 26 have two ink supply ports 21, 21*a* respectively that supply ink from the ink cartridge 61 to the two ink chambers 31, 33 in the manifold plates 24, 25. The manifold plates 24, 25 are formed with ink chambers 31, 33 extending in parallel astride the rows of the nozzles 22 in the nozzle plate 23. End portions of the ink chambers 31, 33 are bent inward so as to communicate with the ink supply ports 21, 21*a*. The ink chambers 33 are opened in the manifold plate 25, and hermetically sealed as the spacer plate 26 is laminated onto the manifold plate 25. The ink chambers 31 are recessed in the manifold plate 24.

The nozzle plate 23 is formed with the nozzles 22 having an extremely small diameter (approximately 25 $\mu$m in this embodiment), from which ink is ejected. The nozzles 22 are disposed in a staggered arrangement along the longitudinal direction of the nozzle plate 23.

The piezoelectric actuator 30 is structured wherein electrodes associated with the pressure chambers 28 are formed on a piezoelectric sheet, as in the case disclosed in Japanese Laid-Open Patent Publication No. 4-341851. The piezoelectric actuator 30 selectively drives pressure generating portions corresponding to each of the pressure chambers 28 to cause ink to be ejected from the nozzles 22.

A cover plate 44, which is an elastic thin metal plate, is fixed on the face side of the piezoelectric ink jet heads 6 so as to cover the piezoelectric ink jet heads 6 (FIG. 2). The cover plate 44 is of a substantially box shape defined by a bottom wall 44*b* and side walls 44*c* standing around the bottom wall 44*b*. The bottom wall 44*b* is formed with windows 44*a* where the nozzle plates 23 are accommodated in such a manner to face the nozzles 22 outward. A flange 44*d*, protruding externally, is formed around edges of the side walls 44*c* of the cover plate 44 (FIG. 3).

The body frame 1 has channels 50, 51 where the side walls 44*c* and the flange 44*d* of the cover plate 44 are inserted (FIG. 9). Ribs 52 are formed on the body frame 1 with a distance from both ends of the bottom plate 5. The channels 50 are defined between ribs 52 and the bottom plate 5, and the channel 51 is formed on a side of the bottom plate 5 and connected to the channels 50. The channels 50, 51 are arranged in a substantially U shape along the three sides of the bottom plate 5. End portions of the channels 50 along the ribs 52 are connected to the side portion 5*a* of the bottom plate 5.

Figure 10:
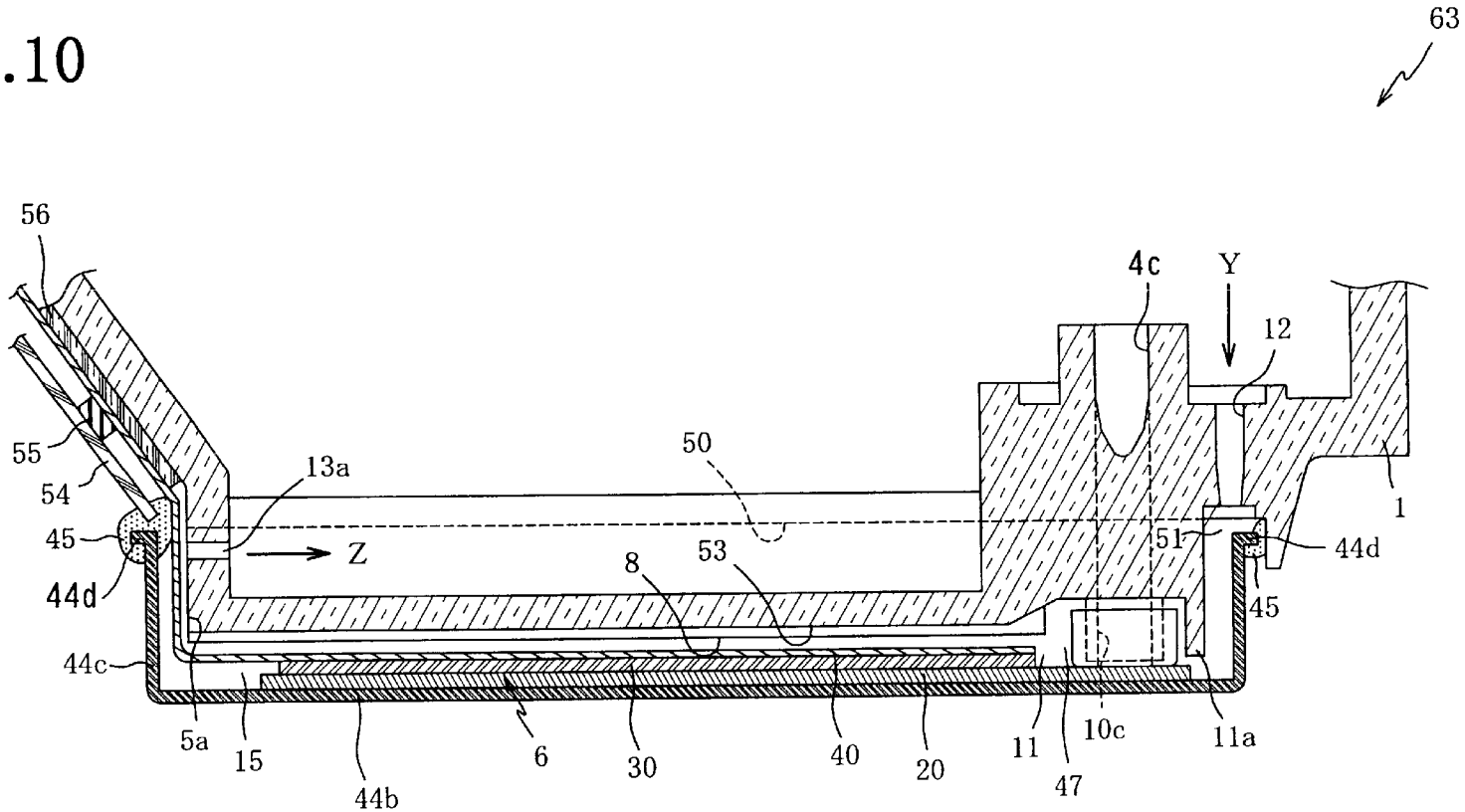
FIG. 10 is a sectional view taken along line X—X of FIG. 9 according to the first embodiment.

Filler inlets 12, from which a filler 46 of silicon resin is supplied, are formed at a bottom of the channel 51 associated with end portions of the supporting portions 8. The filler inlets 12 are located between a pair of the connecting portions 10*a*, 10*b* and between a pair of the connecting portions 10*c*, 10*d*. Each of the filler inlets 12 is open through the body frame 1 toward the installation portion 3 where the ink cartridge 61 is mounted, which is the opposite side where the cover plate 44 is overlaid. The side portion 5*a* of the bottom plate 5 has vents 13*a* (FIGS. 3 and 10). Each of the vents 13*a* is open through the body frame 1 toward the installation portion 3. The engagement grooves 11 are closed at places associated with the filler inlets 12 by walls 11*a*, and have openings 11*b* which contact with the channels 51 at places associated with the pair of the connecting portions 10*a*, 10*b*, and the pair of the connecting portions 10*c*, and 10*d*.

Channels 53 extending in parallel with the channels 50 are formed in the center of each of the supporting portions 8. The channels 53 communicate with the engagement grooves 11 between connecting portions 10*a*, 10*b* and between the connecting portions 10*c*, 10*d* at one end, and connect to the side portion 5*a* of the bottom plate 5 at the other end. Each of the supporting portions 8 is formed with a plurality of vents 13*b* which pass through the body frame 1 to the installation portion 3.

A lid plate 54 (FIG. 2) is secured to a surface of the body frame 1 continuing to the side portion 5*a* of the bottom plate 5 so as to cover the flexible flat cable 40 extending along the surface. The flexible flat cable 40 has a chip 55 (FIG. 10) to drive the piezoelectric actuator 30, and is pressed by an elastic member 56 of rubber or sponge, so that the chip 55 is in contact with the lid plate 54. By doing so, the chip 55 discharges a heat, incident to driving, to the lid plate 54 functioning as a heat sink.

Figure 11:
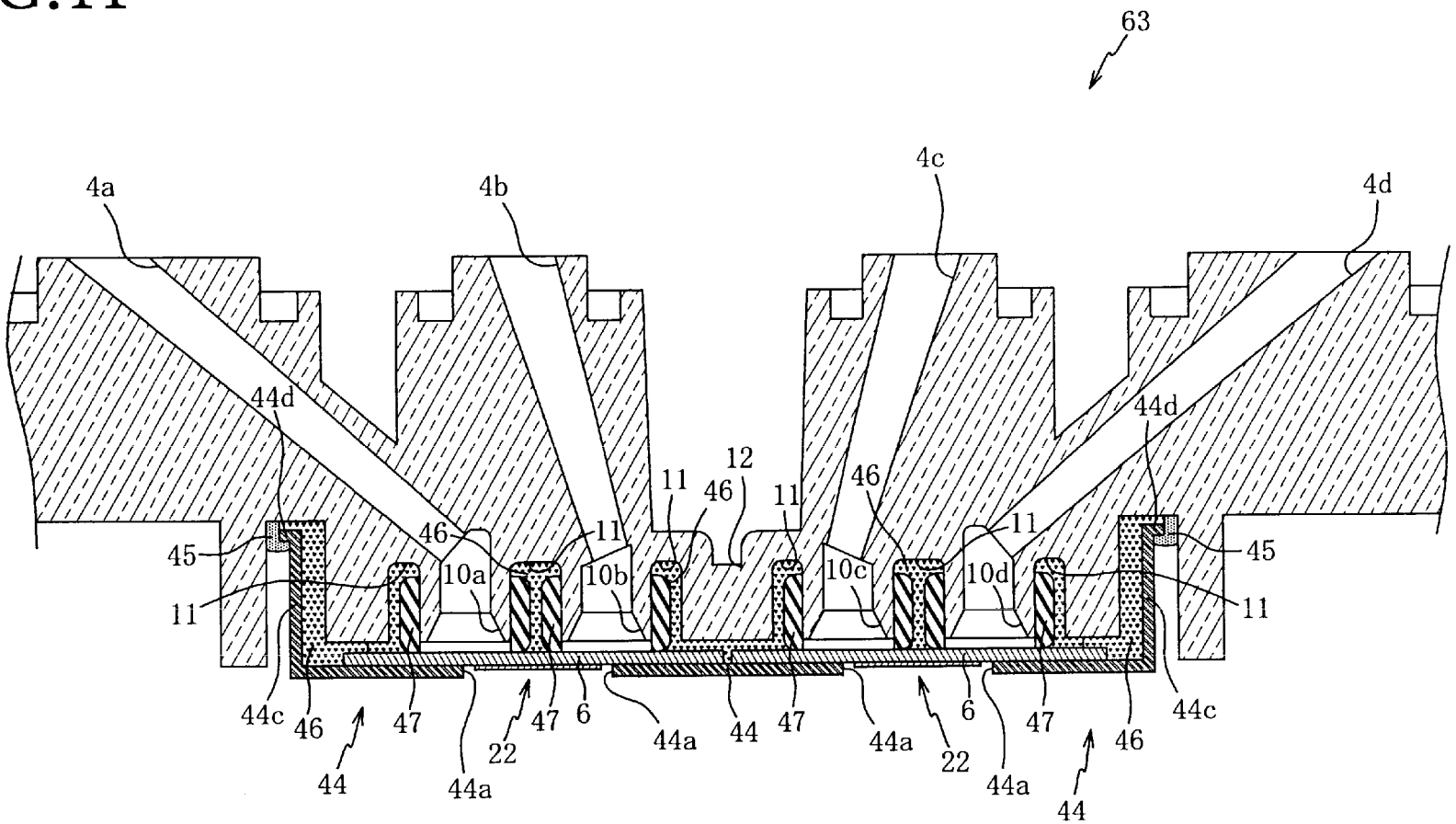
FIG. 11 is a sectional view taken along line XI—XI of FIG. 5 according to the first embodiment.
Figure 12:
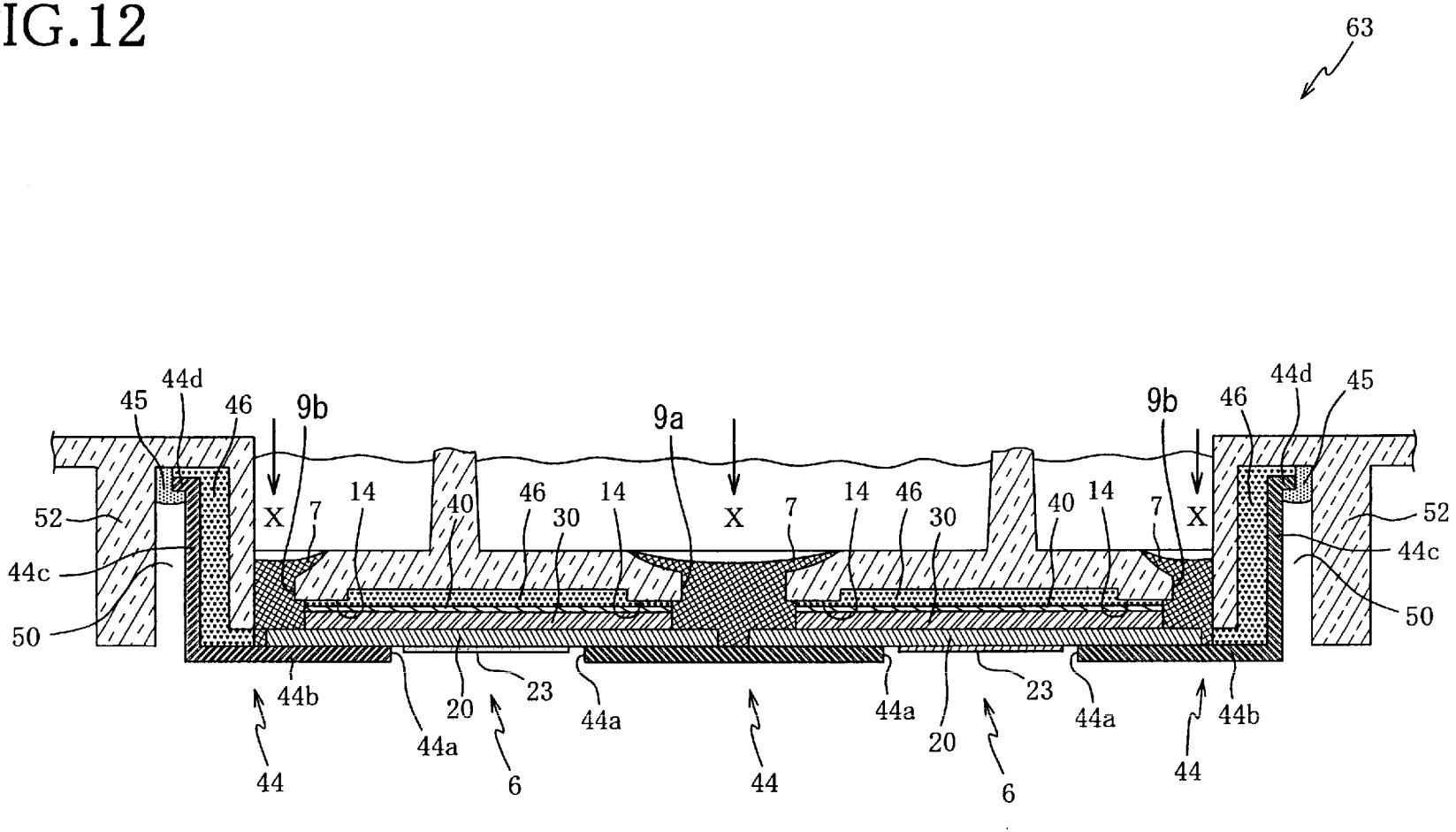
FIG. 12 is a sectional view taken along line XII—XII of FIG. 5 according to the first embodiment.

A method of producing the head unit 63 will be described. FIG. 10 is a sectional view taken along line X—X of FIG. 9. FIGS. 11 and 12 are sectional views taken along line XI—XI and line XII—XII of FIG. 5, respectively. FIG. 10 shows a state that the filler 46 is to be supplied into an internal space 15 where the piezoelectric ink jet head 6 is accommodated. FIGS. 11 and 12 show a state that the filler 46 has been supplied.

To produce the head unit 63, the two piezoelectric ink jet heads 6 are placed in position and secured to the cover plate 44. In detail, as shown in FIG. 4, the cover plate 44 is placed facedown on a jig (not shown). The piezoelectric ink jet heads 6 are overlaid on the cover plate 44, so that the nozzle plates 23 of the two piezoelectric ink jet heads 6 are aligned with the windows 44*a* of the cover plate 44, and the rows of the nozzles 22 are arranged in parallel with each other at established intervals. The piezoelectric ink jet heads 6 and the cover plate 44 are connected by the use of a sealer 45 doubling as an adhesive therebetween.

The body frame 1 is placed on the piezoelectric ink jet heads 6 from above. The piezoelectric ink jet heads 6 are set in agreement with the supporting portions 8. The UV adhesive 7, which is a fast setting and viscous denatured acrylic resin-base adhesive, is applied at the holes 9*a* and 9*b* in a direction of X of FIG. 12 from the topside of the body frame 1. An ultraviolet light is radiated to the holes 9*a, 9b* from the topside of the body frame 1. The UV adhesive 7 sets in a short time (within several tens of seconds).

When the piezoelectric ink jet heads 6 are set on the supporting portions 8, the ink supply ports 21 in the piezoelectric ink jet heads 6 are arranged in agreement with the connecting portions 10*a* to 10*d* via the packings 47. At this time, crevices 14 are formed among the supporting portions 8, the flexible flat cable 40, the piezoelectric actuator 30, and further the cavity plate 20. However, because the UV adhesive 7 gets in such crevices 14 and solidifies instantly, the piezoelectric ink jet heads 6 can be secured to the main body 1 without excess external forces exerted on the piezoelectric ink jet heads 6 by the main body 1. The cover plate 44 does not have a rigidity as much as it can immovably hold the two piezoelectric ink jet heads 6. Therefore, as the cavity plates 20 of the piezoelectric ink jet heads 6 are maintained in parallel with the jig, the rows of nozzles 22 in the cavity plates 20 are precisely in place.

The holes 9*a, 9b* are arranged in such a manner to face the four corners of each of the piezoelectric ink jet heads 6 substantially rectangular in a plan view. This can minimize the misalignment of the piezoelectric ink jet heads 6, which results from curing shrinkage of the UV adhesive 7. Each of the piezoelectric ink jet heads 6 is fixed at the four corners thereof. By doing so, there is an advantage that the nozzle plates 23 do not become deformed when they are pressed in tight contact with the rubber cap 85 (FIG. 1) to prevent the nozzles 22 from drying while the printer 100 is not used.

Further, as shown in FIG. 12, the holes 9*a* are widely formed in such a manner that each of the holes 9*a* spreads astride the two piezoelectric ink jet heads 6 arranged in parallel. Thus, the two piezoelectric ink jet heads 6 can be fixed at one hole 9*a* by supplying the UV adhesive 7 to the hole 9*a* and radiating the ultraviolet light to cure the UV adhesive 7. This greatly contributes to reduced operating speed and improved manufacturing efficiencies. The piezoelectric ink jet heads 6 are secured to the cover plate 44 by the use of the adhesive, and then secured to the body frame 1. However, the piezoelectric ink jet heads 6 can be first secured to the body frame 1 and then the cover plate 44 can be secured to the piezoelectric ink jet heads 6.

The body frame 1, the piezoelectric ink jet heads 6, and the cover plate 44, which are bonded to each other, are placed in such a manner that the nozzles 22 can face upward as shown in FIG. 2, and the periphery of the cover plate 44 is sealed. When the piezoelectric ink jet heads 6 are attached to the body frame 1, the side walls 44*c* and the flange 44*d* on the three sides of the cover plate 44 are inserted into the channels 50, 51 of the bottom plate 5. The sealer 45 is applied to the flange 44*d* to be supplied between the side walls 44*c* and the channels 50, 51, as shown in FIGS. 10 to 12.

The lid plate 54 is secured to the surface of the body frame 1 so as to cover the flexible flat cable 40. A juncture between the lid plate 54 and the body frame 1 is similarly sealed with the sealer 45. A juncture between a remaining side of the cover plate 44 and the lid plate 54 is also sealed with the sealer 45.

After the juncture between the body frame 1 and the cover plate 44 is sealed, an operation is shifted to a filling process. The filler 46 is supplied into the internal space 15 formed between the body frame 1 and the cover plate 44. As shown in FIG. 10, the filler 46 is inserted into the filler inlet 12 from the installation portion 3 side (in a direction of Y). The filler 46 inserted into the filler inlet 12 flows inside the internal space 15 while releasing air remaining inside to the vents 13*a, 13b*. The filler 46 flows in passages from the channel 51 to the channels 50 and in passages from the channel 51 to the channels 53. In the former passages from the channel 51 to the channels 50, the filler 46 is charged between sides of the bottom plate 5 and the inner surfaces of the side walls 44*c* of the cover plate 44 associated with the channels 51, 50. In the latter passages from the channel 51 to the channels 53, the filler 46 is charged in the engagement grooves 11, so that the ink supply ports 21 in the cavity plates 20 and connecting portions 10*a* to 10*d* are sealed along with the packings 47. The filler 46 then flows in the channels 53 along the upper surfaces of the piezoelectric ink jet heads 6.

The filler 46 flowing along the channels 50, 53 moves sideways into narrow gaps between the piezoelectric ink jet heads 6 and the supporting portions 8. Further, the filler 46 is charged between the side portion 5*a* of the bottom plate 5 and the inner surface of the side wall 44*c* of the cover plate 44 from ends of the channels 50, 53. By doing so, the surrounding area of the piezoelectric ink jet heads 6 is sealed with the filler 46. As a result, ink does not enter the internal space 15 and erode the UV adhesive 7, so that a short circuit at an electrical connecting point between the piezoelectric actuator 30 and the flexible flat cable 40 can be prevented.

As described above, while the filler 46 flows, the air remaining inside the internal space 15 is released from the vents 13*a* located farthest from the filler inlets 12, and the vents 13*b* located corresponding to the narrow gaps between the piezoelectric ink jet heads 6 and the supporting portions 8 away from the channels 50, 53. When the filler 46 is charged, it is ejected from the vents 13*b* near the filler inlets 12 one after another. As a result, it can be seen how far in the internal space 15 the filler 46 is charged. When the filler 46 is ejected from the vents 13*a* located at the ends of the internal space 15, which is the farthest from the filler inlets 12, it can be seen that charging of the filler 46 is completed. Therefore, if there are variations of sizes of elemental parts, such as the body frame 1 and the piezoelectric ink jet heads 6, variations of charging conditions such as a temperature when the filler 46 is charged, or variations of charging characteristics of a charging device, the charging status can be seen from the filler 46 ejected from the vents 13*a, 13b*. In this way it is easy to detect poor charging of the filler 46.

The vents 13*a, 13b* have different internal diameters. In the embodiment, the farther the vent is located from the filler inlets 12, the greater the internal diameter of the vent. That is, of the vents 13*b*, a vent 13*b* located nearest to the filler inlets 12 has the smallest internal diameter. A vent 13 a located the farthest from the filler inlets 12 has the greatest internal diameter. The filler 46 continues to be discharged from the vents 13*b* scattered on the way to the ends of the internal space 15 which are located the farthest from the filler inlets 12. To save the filler 46, the internal diameter of the vents from which the filler 46 is discharged for a long time (nearer the filler inlets 12) is set smaller. Thus, the amount of the discharged filler 46 can be saved, and as a result, total quantity consumed of the filler 46 can be reduced.

The internal diameter of each of the vents 13*a, 13b* is set according to the distance from the filler inlets 12. However, it is preferred to change the internal diameter according to the shape of the internal space 15. When the shape of the internal space 15 is complicated, the filler 46 is reluctant to flow to a blind spot viewed from the filler inlets 12 even if it is near the filler inlets 12, so that air is easily trapped in such a place. Such air can be released by providing a vent having a small internal diameter in such a place.

The filler inlets 12 and the vents 13*a,* 13*b* may be provided on the cover plate 44, however, they are preferably provided on the body frame 1 rather than the cover plate 44 because product appearance may be impaired or the adhered filler 46 should be removed.

As shown in FIGS. 3 and 9, the connecting portions 10*a* to 10*d* in the body frame 1 and corresponding ink supply ports 21 of the piezoelectric ink jet heads 6 are sealed with the packings 47 inserted into the engagement grooves 11 recessed around the connecting portions 10*a* to 10*d*. However, it is preferred that the engagement grooves 11 are previously filled with the filler 46 as soon as the packings 47 are inserted thereinto. By doing so, while the piezoelectric ink jet heads 6 and the body frame 1 are adhesively fixed to each other, the ends of the packings 47 are pressed so as to enclose the ink supply ports 21 of the piezoelectric ink jet heads 6, at the same time, the sealer 45 makes contact with the piezoelectric ink jet heads 6, so that the ink supply ports 21 and the packings 47 are hermetically sealed. The filler 46 supplied in the charging process is further overlaid on a portion hermetically sealed, thereby improving the reliability of the sealed fit.

According to the first embodiment, the vents 13*a,* 13*b* are drilled into the body frame 1. At least one vent may be provided at an end of the internal space 15 which is substantially the farthest from the filler inlets 12. Alternatively, a number of vents may be drilled at the end of the internal space 15. The vents have different internal diameters in the embodiment, however, the vents may have the same internal diameter.

According to the first embodiment, two piezoelectric ink jet heads 6 are provided in parallel with each other. However, in the example, the number of piezoelectric ink jet heads 6 is arbitrary. One to four piezoelectric ink jet heads may be provided.

Figure 13:
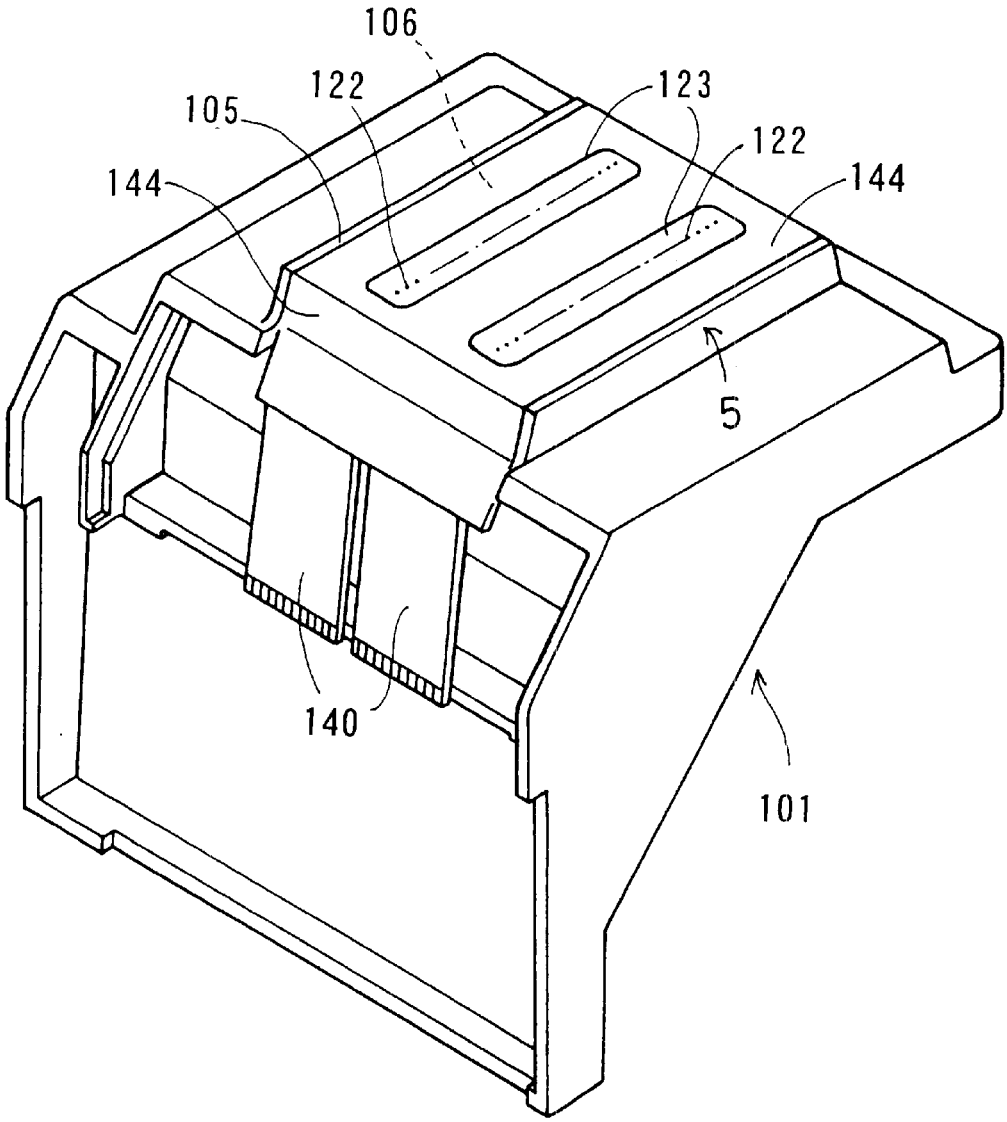
FIG. 13 is a perspective view of a head unit according to a second embodiment of the invention according to the second embodiment.
Figure 14:
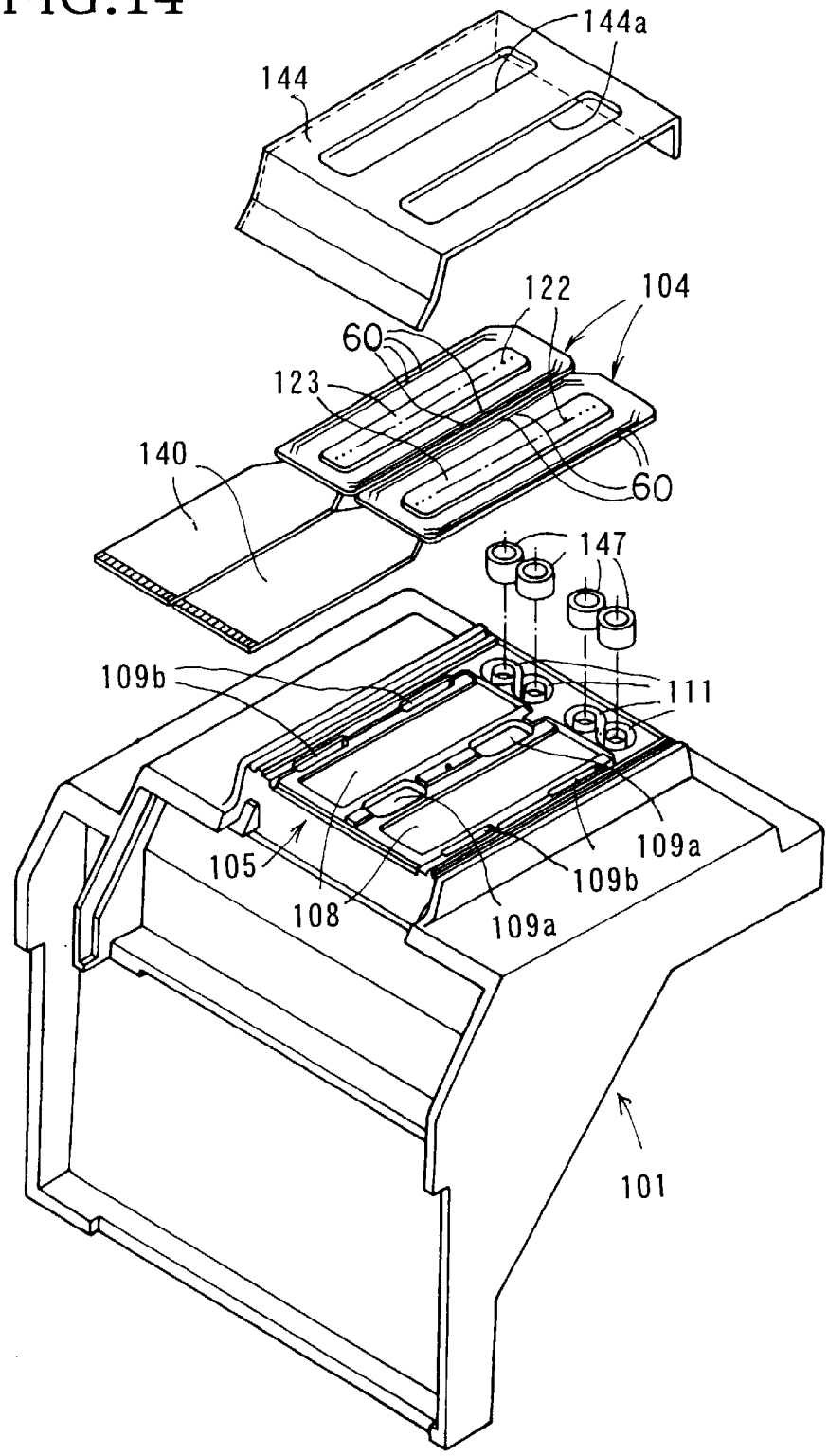
FIG. 14 is a perspective view of the head unit disassembled into structural parts according to the second embodiment.
Figure 15:
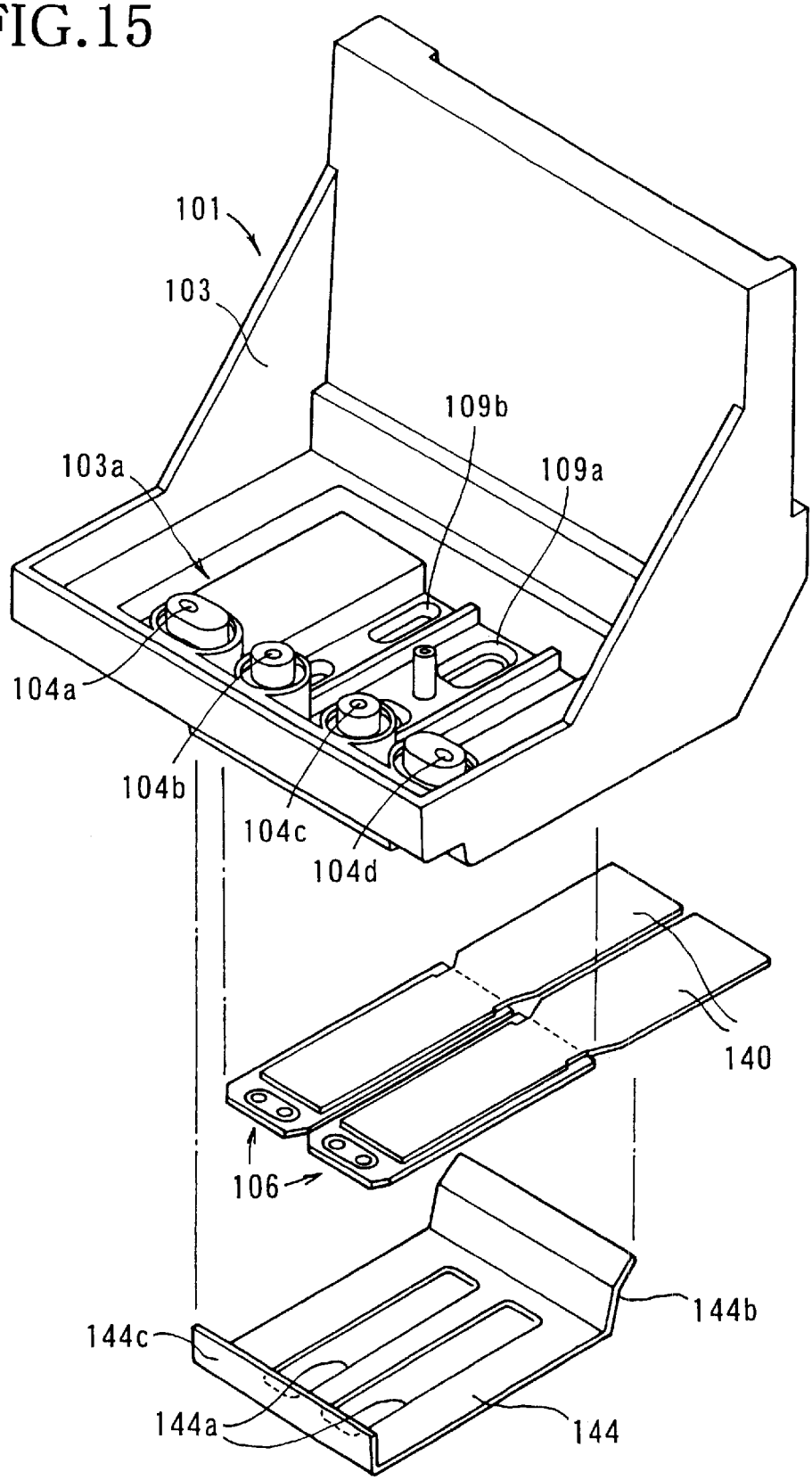
FIG. 15 is a perspective view of the head unit disassembled into structural parts according to the second embodiment.
Figure 17:
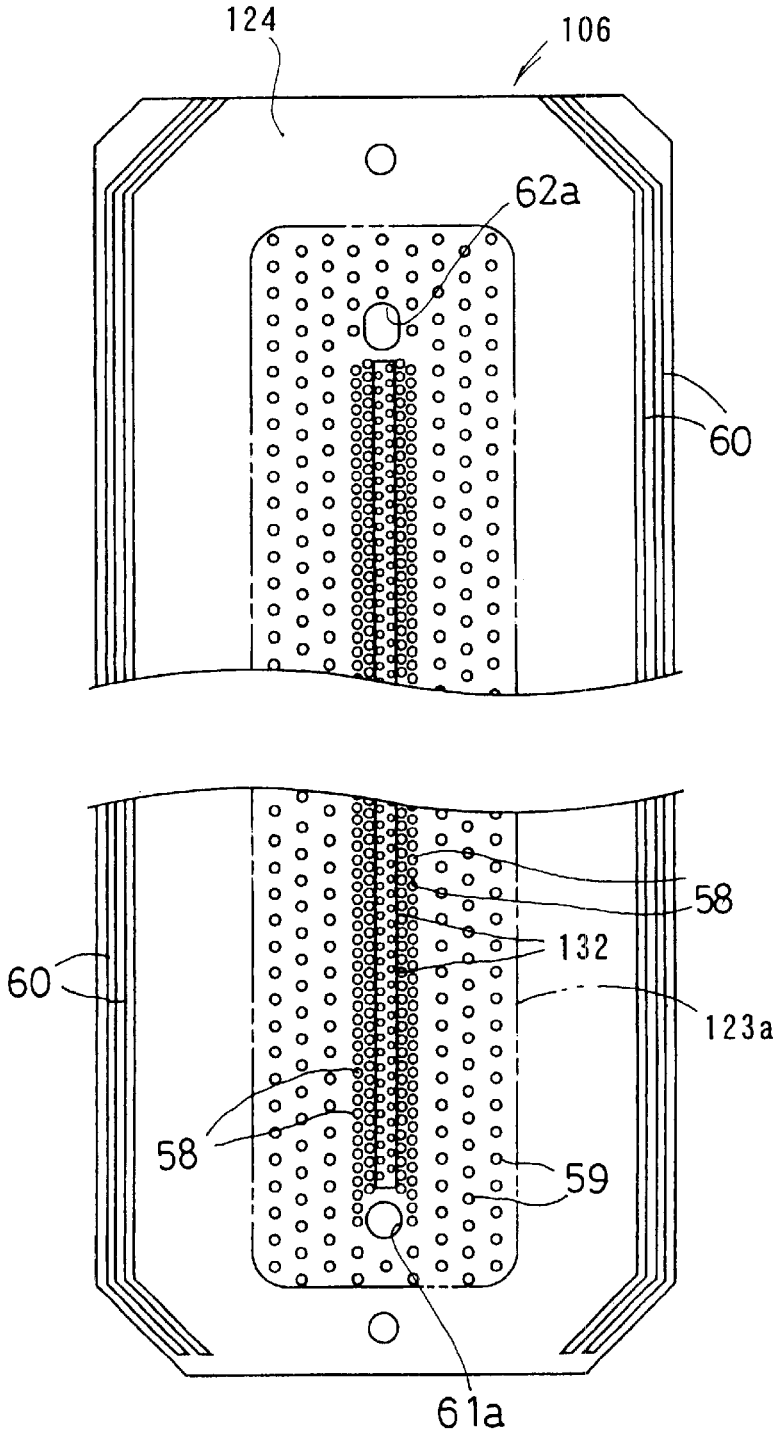
FIG. 17 is a partially enlarged cutaway view of a bonding area on a rear side surface of the piezoelectric ink jet head according to the second embodiment.
Figure 19:
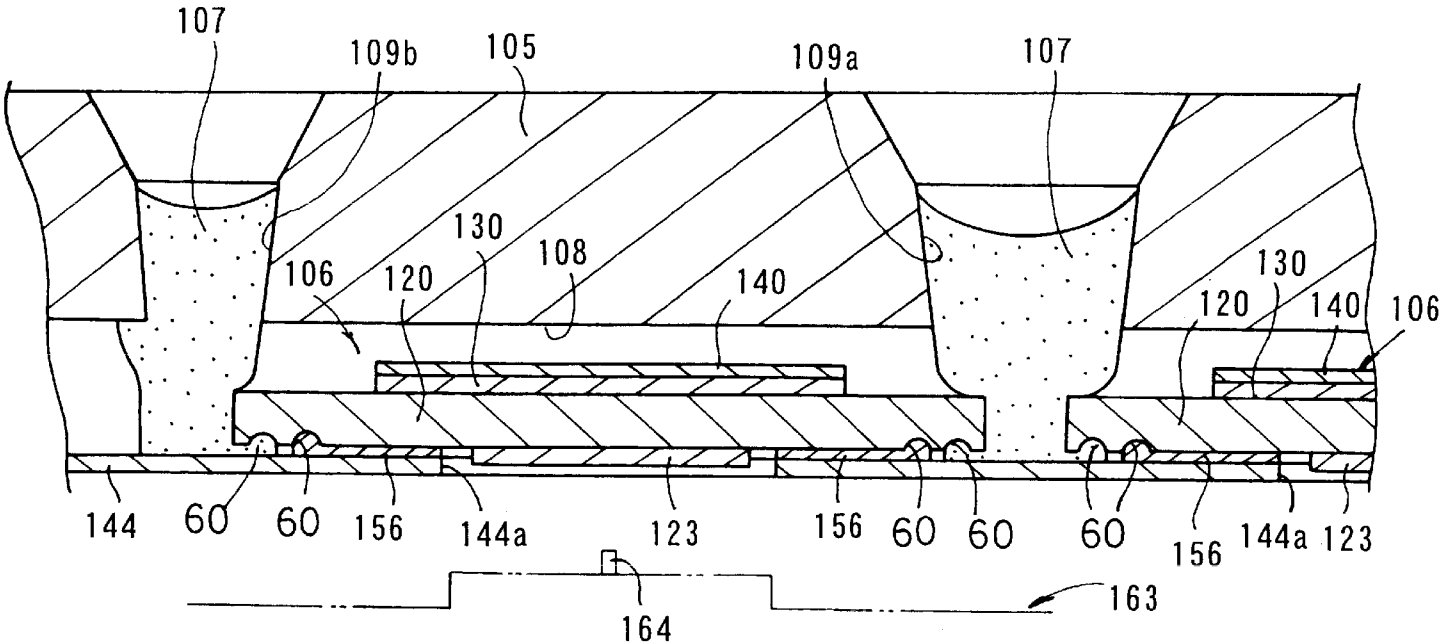
FIG. 19 is an enlarged sectional view of a bonding portion among the body frame, the piezoelectric ink jet heads, and the cover plate, taken along the arrowed line VII—VII of FIG. 16, according to the second embodiment.
Figure 23:
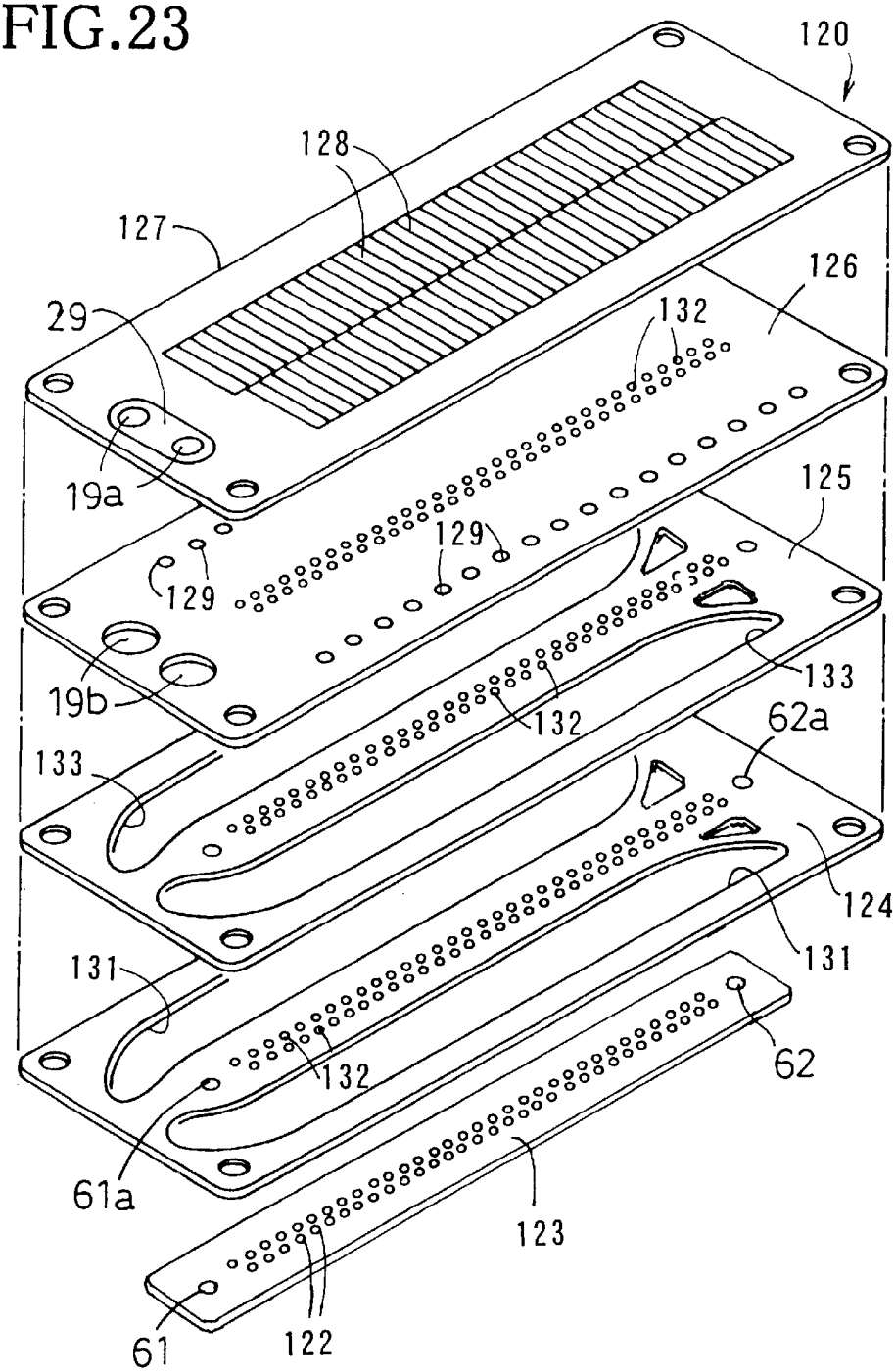
FIG. 23 is an exploded perspective view of parts of a cavity plate according to the second embodiment.
Figure 25A:
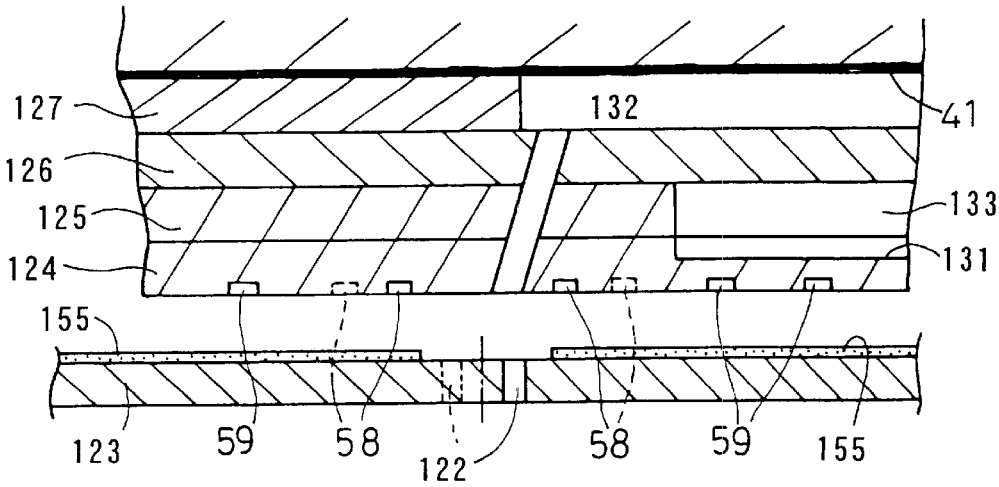
FIG. 25A is an enlarged sectional view of a bonding portion between the cavity plate and the nozzle plate according to the second embodiment.
Figure 25B:
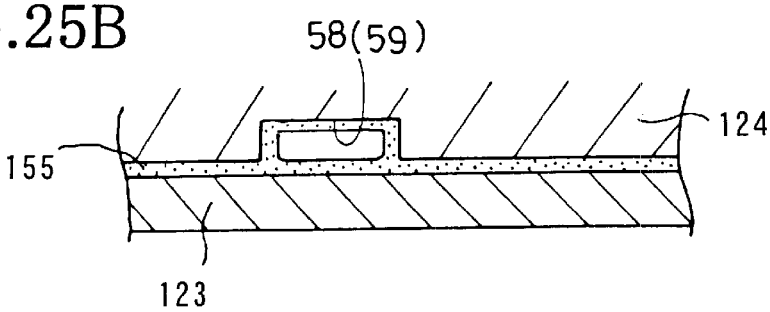
FIG. 25B is an enlarged sectional view of an agent-receiving portion according to the second embodiment.

A second embodiment of the invention will be described. FIGS. 13, 14, and 15 are perspective views of piezoelectric ink jet heads according to the second embodiment of the invention. FIG. 17 is a rear side surface of one piezoelectric ink jet head. FIG. 19 is a sectional view showing that a bottom plate, the piezoelectric ink jet heads and a cover plate are adhered. FIG. 23 is a perspective view of elemental parts of a cavity plate. FIG. 25A is an enlarged sectional view showing a nozzle plate adhered to the cavity plate. FIG. 25B is an enlarged sectional view of a recess.

As shown in FIGS. 13 to 19, a head unit of the second embodiment includes a body frame 101, two piezoelectric ink jet heads 106, and a cover plate 144. The body frame 101 is an injection molded article and made of a synthetic resin such as polyethylene and polypropylene. The two piezoelectric ink jet heads 106 are arranged in parallel on a lower surface of a bottom plate 105 of the body frame 101. The cover plate 144 is fixed over the piezoelectric ink jet heads 106 and the body frame 101. The cover plate 144 has two windows 144*a* from which nozzles 122 on the piezoelectric ink jet heads 106 are exposed.

The body frame 101 has a substantially box shape and an upper open structure (FIG. 15). The upper open structure is provided with an installation portion 103 to detachably attach an ink cartridge 102 (FIG. 21) having four inks as ink supply sources. Ink supply passages 104*a,* 104*b,* 104*c,* and 104*d,* which are connected to an ink discharging portion (not shown) of the ink cartridge 102 to be installed in the installation portion 103, are drilled in a stepped portion 103*a* of the installation portion 103. Each of the ink supply passages 104*a,* 104*b,* 104*c,* and 104*d* is in communication with an undersurface of the bottom plate 105 of the body frame 101.

Figure 16:
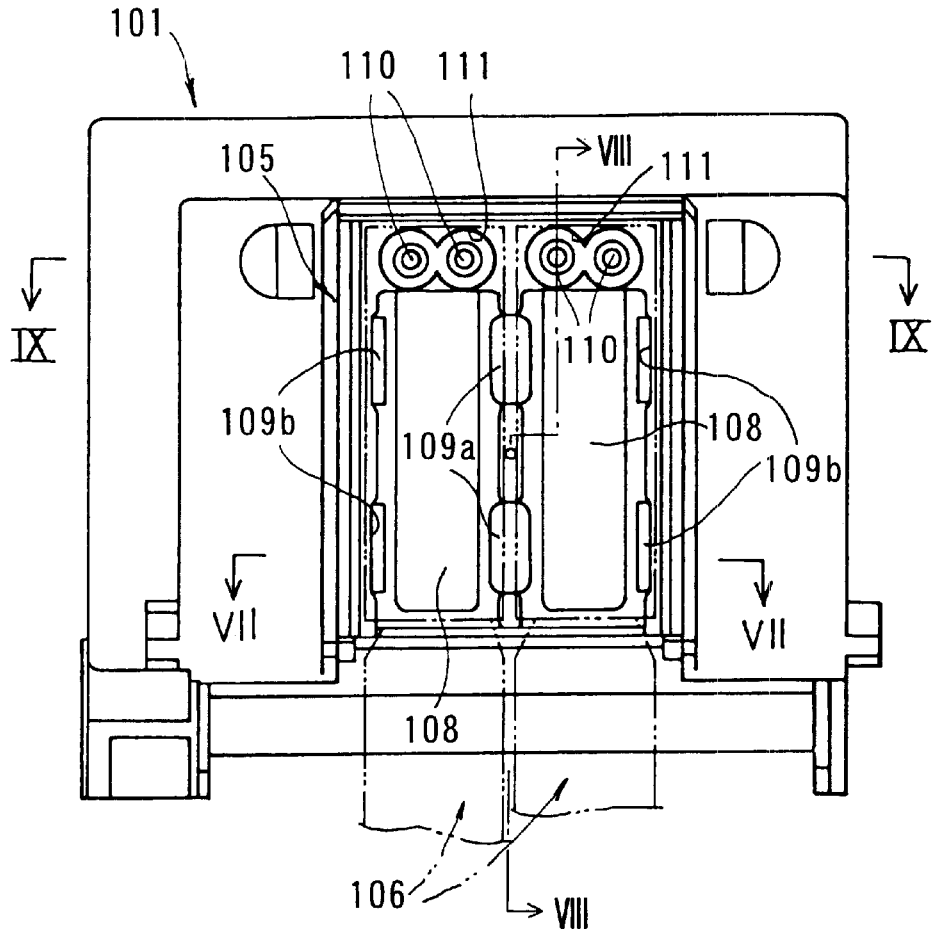
FIG. 16 is a top view of a body frame according to the second embodiment.
Figure 21:
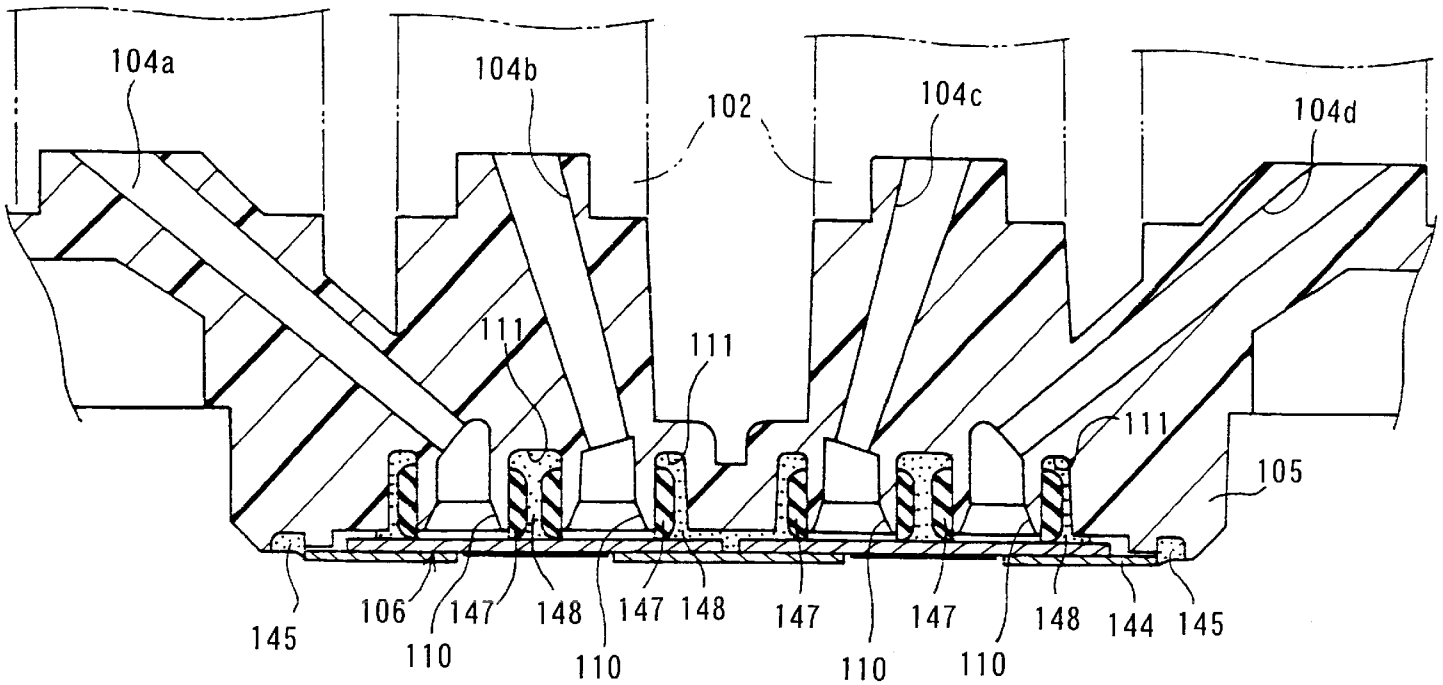
FIG. 21 is an enlarged sectional view taken along the arrowed line IX—IX of FIG. 16 according to the second embodiment.

The bottom plate 105 is formed horizontally so as to protrude from the installation portion 103. The bottom plate 105 has two stepped supporting portions 108, where two piezoelectric ink jet heads 106 are arranged in parallel. Connecting portions 110 associated with the ink supply passages 104*a* to 104*d* are provided on one end of the supporting portions 108, as shown in FIGS. 16 and 21. Engagement grooves 111 substantially ring-shaped in a plan view are recessed around the connecting portions 110. Ring-shape packings 147 of soft rubber, which have a good sealing fit, are inserted into the engagement grooves 111. (Refer to FIGS. 14 and 21.)

The supporting portions 108 in the bottom plate 105 have through holes 109*a,* 109*b,* where a fast-setting UV adhesive 107, as a first adhesive, is supplied so as to fix the piezoelectric ink jet heads 106. The piezoelectric ink jet heads 106 and the cover plate 144 that covers the piezoelectric ink jet heads 106, except for nozzle plates 123 at the front side surfaces of the piezoelectric ink jet heads 106, are fixed to each other via the UV adhesive 107 supplied from the through holes 109*a,* 109*b.*

When the piezoelectric ink jet heads 106 are fixed to the stepped supporting portions 108, a gap between the supporting portions 108 and flexible flat cables 140 on the back of each of the piezoelectric ink jet heads 106 is formed.

Figure 18:
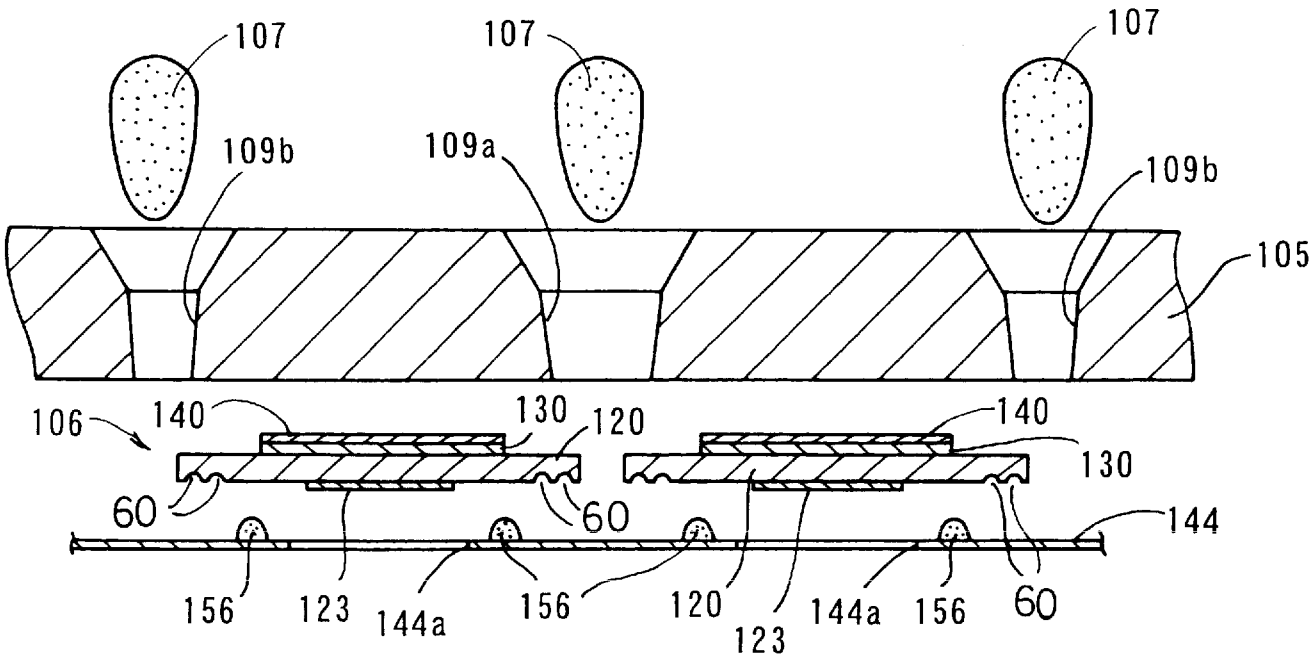
FIG. 18 is an enlarged sectional view of a bonding process among the body frame, the piezoelectric ink jet heads, and a cover plate according to the second embodiment.

As shown in FIGS. 14, 18, and 19, the through holes 109*a,* 109*b* are drilled in such a manner to face the four corners of each of the piezoelectric ink jet heads 106. The through holes 109*a* are widely formed between the two supporting portions 108 so as to spread across the two piezoelectric ink jet heads 106 arranged in parallel.

Rubber packings (not shown) are disposed around each of the ink supply passages 104*a* to 104*d* on the stepped portion 103*a* of the installation portion 103 so as to fit with the ink discharging portion.

Figure 26:
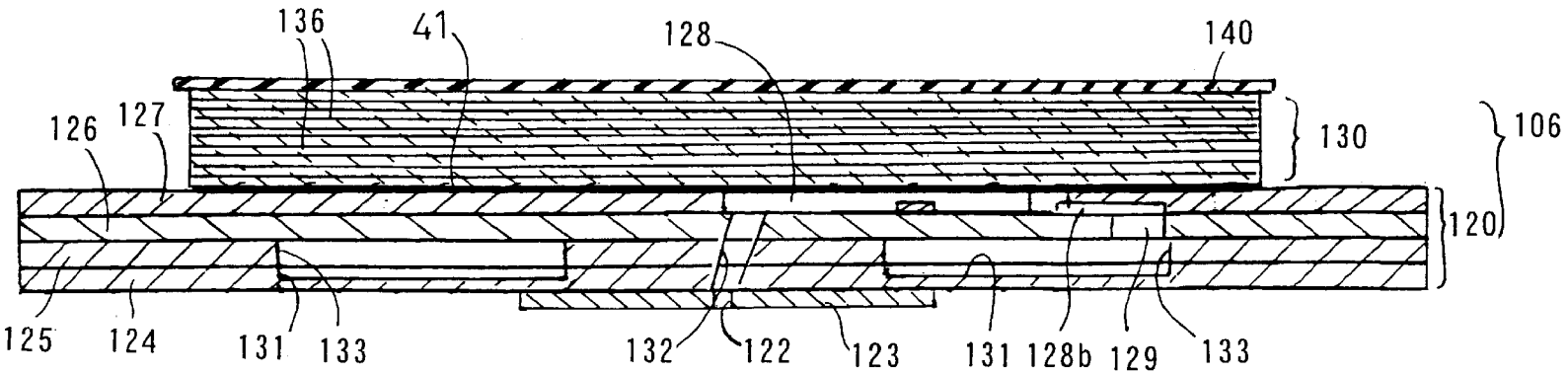
FIG. 26 is an enlarged sectional side view of the piezoelectric ink jet head according to the second embodiment.

The structure of the front side surface of the piezoelectric ink jet head 106 will be described. As shown in FIGS. 14, 17, 23, 24, and 25A, a nozzle plate 123 is adhesively fixed to the middle of the front side surface (lower surface) of the cavity plate 120 by the use of an adhesive 155 (FIG. 25A). The nozzle plate 123 is a thin plate made of synthetic resin, which has two rows of staggered nozzles 122. There are 75 nozzles 122 in one row. (Refer to FIGS. 23 and 24.) Ink is ejected from the nozzles 122 (FIG. 26). A known water-repellent film is formed on the front side surface of the nozzle plate 123.

The cover plate 144 that protects the front side surface of each of the piezoelectric ink jet heads 106 is a thin metal plate, in which the two windows 144*a* are drilled by stamping work. The two windows 144*a* are arranged with a clearance (FIGS. 14, 15) to enclose the nozzle plates 123 of the piezoelectric ink jet heads 106. The cover plate 144 is fixed to the front side surface (lower surface) of each of the piezoelectric ink jet heads 106, by the use of a second adhesive 156 (FIGS. 18 and 19) made of silicone having ink repellency, which is applied to the periphery of each of the two windows 144*a*. It is desirable that the cover plate 144 is slightly thicker than the nozzle plate 123.

The front side surface (a manifold plate 124) of the piezoelectric ink jet head 106 has two recessed blocking grooves 60 on both sides. The blocking grooves 60 are located outwardly from the peripheral edges of the windows 144*a* of the cover plate 144 and inwardly from the through holes 109*a,* 109*b,* in order to prevent the second adhesive 156 from mixing with the UV adhesive 107. That is, as shown in FIG. 17, the blocking grooves 60 are disposed outside an area 123*a* where the nozzle plate 123 is adhered. The blocking grooves 60 are formed along the rows of the nozzles 122 and through holes 132 in the manifold plate 124.

As shown in FIGS. 17 and 25A, there are many agent-receiving portions 58, 59 recessed in the area 123*a* in a plan view and scattered in the area 123*a* on the manifold plate 124. The agent-receiving portions 58 are located in a first area near the rows of the nozzles 122. The diameter of each of the agent-receiving portions 58 is approximately 0.15 mm in this embodiment, and set slightly greater than that of the nozzles 122 (approximately 0.025 mm). The agent-receiving portions 58 are densely arranged with a pitch of approximately 0.25 mm. The nozzles 122 are arranged with a pitch of approximately 0.34 mm.

The agent-receiving portions 59 are located in a second area outside the first area. The diameter of each of the agent-receiving portions 59 is approximately 0.2 mm in this embodiment, and set slightly greater than that of the agent-receiving portions 58. The agent-receiving portions 59 are non-densely arranged with a pitch of approximately 0.5 mm.

When the adhesive 155 is applied to the area 123*a* including the first area and the second area (FIG. 25A), and is spread by a force exerted when the nozzle plate 123 is adhered to the manifold plate 124, the agent-receiving portions 58, 59 receive a surplus of the adhesive 155 (FIG. 25B).

In addition, the adhesive 155 moistens peripheral walls of the agent-receiving portions 58, 59 and then solidifies. Therefore, a total space where the adhesive 155 is applied becomes larger than that of a planer face of the area 123*a,* and a strength of bond between the nozzle plate 123 and the manifold plate 124 is also increased because the adhesive 155 solidifies on the peripheral walls of the agent-receiving portions 58, 59 and the planar face of the area 123*a* where they intersect each other.

Because the first area where the agent-receiving portions 58 are densely arranged is set near the nozzles 122, it is sufficiently sealed by the adhesive 155. In addition, ink ejected from the nozzles 122 can be prevented from entering the inside of the cavity plate 120 from the clearance between the nozzle plate 123 and the manifold plate 124.

In the embodiment the agent-receiving portions 58, 59 are formed on the manifold plate 124, however, they may be formed on another plate to be adhered to the manifold plate 124.

Positioning holes 61*a,* 62*a* are drilled at a front and rear of the through holes 132 in the area 123*a*. When the nozzle plate 123 is adhered to the front side surface of the manifold plate 124 and the piezoelectric ink jet heads 106 are adhered to the bottom of the body frame 101 in parallel, the positioning holes 61*a,* 62*a* are used. The positioning holes 61*a,* 62*a* are located so as to align with the positioning holes 61, 62 in the nozzle plate 123 shown in FIG. 23.

A method of fixing the piezoelectric ink jet head 106 and the cover plate 144 to the body frame 101 will be described. The cover plate 144 having the two windows 144*a* is placed on a positioning jig 163 (shown by a dot dash line in FIG. 19). The second adhesive 156 is applied to the outer regions around the windows 144*a* from the reverse side surface of the cover plate 144 (FIG. 18).

The positioning holes 61, 62 in the nozzle plates 123 are fit into the positioning pins 164 of the jig 163 (only one shown in FIG. 19). The two nozzle plates 123 are placed so as to expose from the windows 144*a,* and the rows of the nozzles 122 are spaced on the piezoelectric ink jet heads 106 evenly and in parallel with each other. The front side surfaces of the piezoelectric ink jet heads 106 and the reverse side surface of the cover plate 144 are fixedly adhered to each other by the use of the second adhesive 156. The body frame 101 is overlaid thereon, and the piezoelectric ink jet heads 106 are positioned in alignment with the supporting portions 108. The UV adhesive 107 is supplied from the through holes 109*a,* 109*b,* and solidified by the ultraviolet radiation to fix the piezoelectric ink jet heads 106.

By doing so, as shown in FIG. 19, the second adhesive 156 is spread into a thin layer between the front side surface of the manifold plate 124 and the reverse side surface of the cover plate 144 by a pressing force. However, as the second adhesive 156 is blocked at the blocking grooves 60, it is resistant to leaks outwardly therefrom. On the other hand, the UV adhesive 107 tends to flow along the edges of each piezoelectric ink jet head 106 from its reverse side surface, pass through the gaps formed between the piezoelectric ink jet head 106 and the reverse side surface of the cover plate 144, and flow into the windows 144*a.* However, the UV adhesive 107 is also resistant to leaks because of its instantaneous solidification. If the UV adhesive 107 flows into the windows 144*a,* the blocking grooves 60 can prevent the UV adhesive 107 and the second adhesive 156 from mixing.

When different kinds of adhesives are mixed, solidification is difficult, so that a part where it is not solidified occurs. As a result, an electrical short circuit may occur due to leakage of ink. Such a short circuit can be prevented from occurring by the methods and systems as described.

The through holes 109*a,* 109*b* are arranged so as to face the four corners of each of the piezoelectric ink jet heads 106. Thereby, the piezoelectric ink jet heads 106 can be prevented from becoming misaligned due to curing shrinkage of the UV adhesive 107. As shown in FIGS. 16 and 17, the through holes 109*a* are widely formed in such a manner that each of the holes 109*a* spreads astride the two piezoelectric ink jet heads 106 arranged in parallel. Thus, the two piezoelectric ink jet heads 106 can be fixed at one hole 109*a* by supplying the UV adhesive 107 to the hole 109*a* and radiating the ultraviolet light to solidify the UV adhesive 107. This greatly contributes to reduced operating speed and improved manufacturing efficiencies.

Further, an advantage is gained because the nozzle plates 123 do not become deformed when they are pressed in tight contact with a rubber cap that prevents the nozzles 122 from being dried while the printer is not used.

Figure 20:
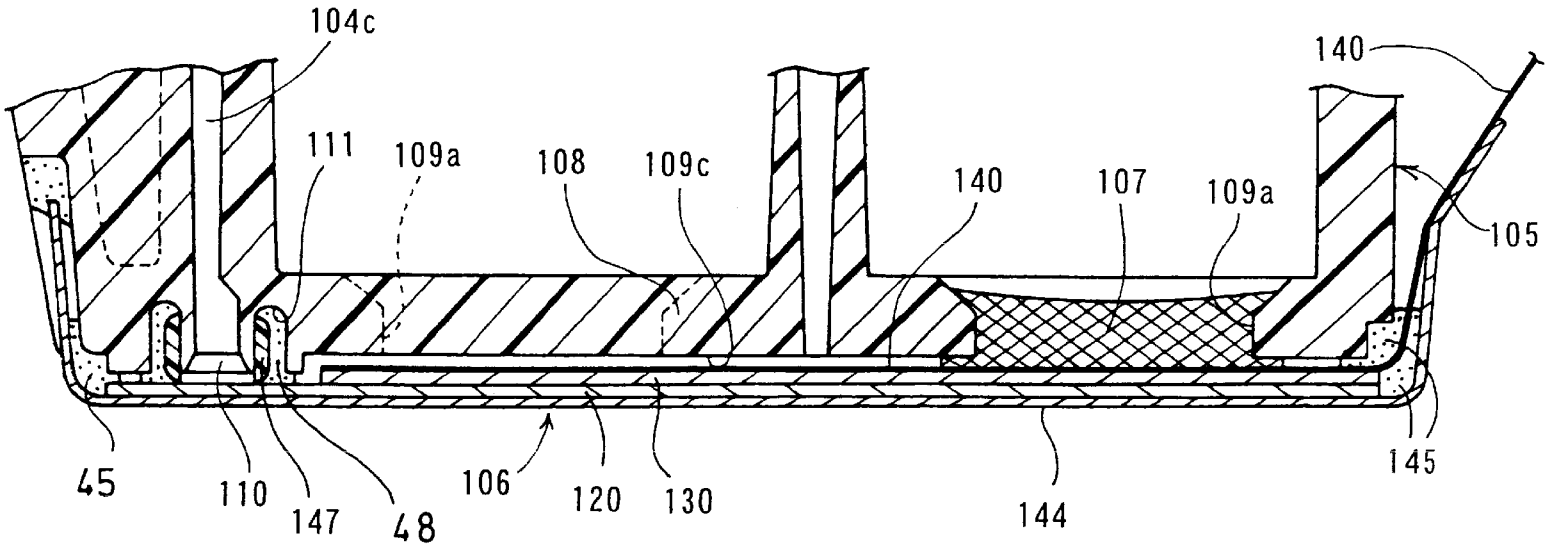
FIG. 20 is an enlarged sectional view taken along the arrowed line VIII—VIII of FIG. 16 according to the second embodiment.

As shown in FIGS. 20 and 21, a sealer 145 is applied between the periphery of the cover plate 144 and the body frame 101. Before the body frame 101 is overlaid on the piezoelectric ink jet heads 106, the sealer 145 should be applied between the flexible flat cable 140 and the body frame 101, between the flexible flat cable 140 and the cover plate 144, and between a bending portion 144*b* of the cover plate 144 and the body frame 101. By doing so, piezoelectric actuators 130 and electrical connecting portions in the piezoelectric ink jet heads 106 can be completely sealed, thereby preventing foreign matter such as ink and dust from intruding from outside.

The piezoelectric ink jet heads 106 and the parts that makeup the heads 106 will be described. As shown in FIGS.

22 to 24, each piezoelectric ink jet head 106 includes a multi-layered cavity plate 120, a plate-type piezoelectric actuator 130, and a flexible flat cable 140. The piezoelectric actuator 130 is adhered to the cavity plate 120 via an adhesive sheet 41 (FIG. 26), and the flexible flat cable 140 is bonded to the top of the piezoelectric actuator 130 for electrical connection with external equipment.

Figure 22:
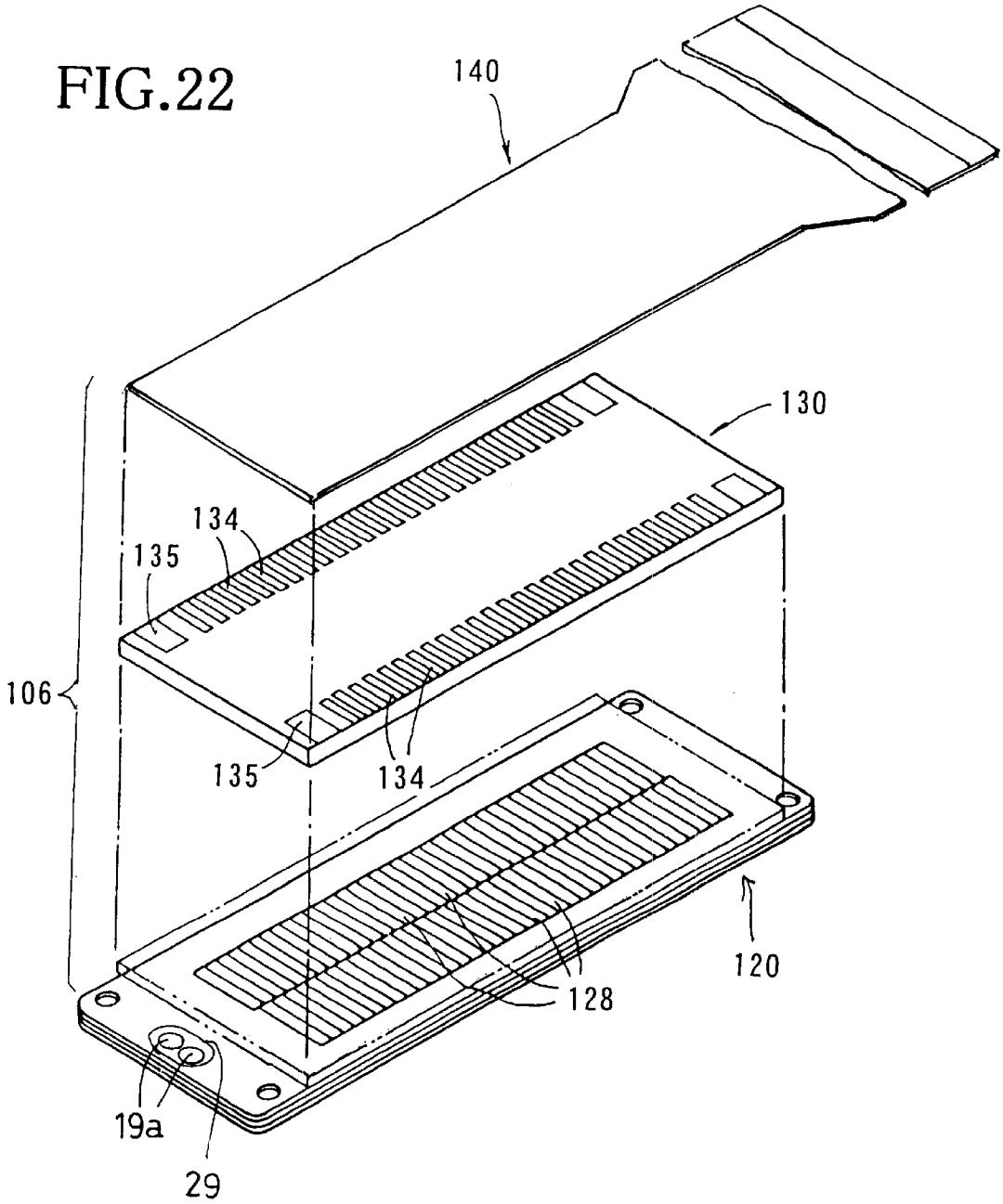
FIG. 22 is an exploded perspective view of the piezoelectric ink jet head according to the second embodiment.

A filter 29 (FIGS. 22, 23) for eliminating dust in the ink supplied from the ink cartridge 102 is adhesively fixed over ink supply ports 19*a* drilled on one side of the base plate 127, which is on the reverse side surface of the piezoelectric ink jet head 106. When the cavity plate 120 is attached to the body frame 101, the ink supply ports 19*a* make contact with the packings 147 and communicate with the ink supply passage 104*a*.

Figure 24:
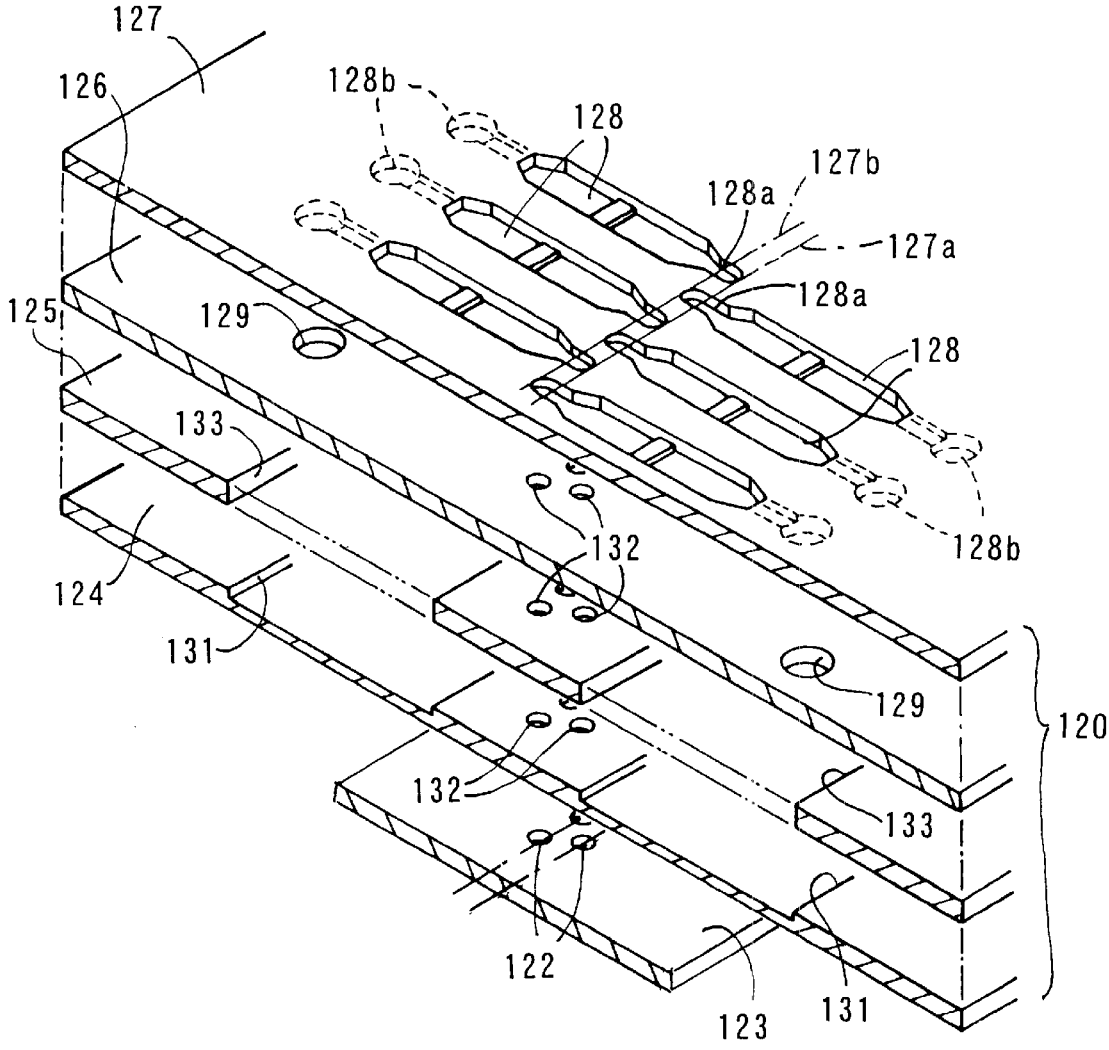
FIG. 24 is a partially enlarged perspective view of the cavity plate according to the second embodiment.

As shown in FIGS. 23 and 24, the cavity plate 120 includes five thin metal plates: a nozzle plate 123, two manifold plates 124, 125, a spacer plate 126, and a base plate 127, which are adhesively bonded to each other. In this embodiment, each plate is made of steel alloyed with 42% nickel and has a thickness of 50 $\mu$m–150 $\mu$m. Each plate is not limited to be constructed of metal and may be made of other material such as resin or ceramics.

The manifold plate 124 is adhered to the nozzle plate 123. The through holes 132 communicating with the nozzles 122 are longitudinally staggered in two rows, with a fixed pitch, on the manifold plates 124, 125 and the spacer plate 126. The manifold plates 124, 125 are formed with ink chambers 131, 133 extending along the rows of the through holes 132. The ink chambers 131 are recessed in the manifold plate 124 (FIG. 24). The ink chambers 131, 133 in the manifold plates 124, 125 are hermetically sealed as the spacer plate 126 is laminated onto the manifold plate 125.

The base plate 127 has two rows of staggered narrow pressure chambers 128 each of which extends in a direction orthogonal to a centerline along a longitudinal direction of the base plate 127. Reference lines 127*a*, 127*b*, which are parallel to each other, are set at both sides of the centerline. Narrow end portions 128*a* of the pressure chambers 128 on the left of the centerline are disposed on the reference line 127*a*, and the narrow end portions 128*a* of the pressure chambers 128 on the right of the centerline are disposed on the reference line 127*b*. The narrow end portions 128*a* of the pressure chambers on the right and left sides of the centerline are alternately positioned. That is, alternate pressure chambers 128 extend from the narrow end portions 128*a* in direction opposite to each other.

The narrow end portions 128*a* of the pressure chambers 128 communicate with the staggered through holes 132 drilled in the spacer plate 126 and the manifold plates 124, 125. Other end portions 128*b* of the pressure chambers 128 communicate with the ink passages 131, 133 in the manifold plates 124, 125 via ink supply holes 129 drilled on opposite sides of the spacer plate 126. As shown in FIGS. 24 and 26, the other end portions 128*b* of the pressure chambers 128 are recessed on the lower surface of the base plate 127.

By doing so, ink flows in the ink passages 131, 133 from ink supply ports 19*a*, 19*b* drilled at an end portion of the base plate 127 and the spacer plate 126, passes from the ink passage 133 to the ink supply holes 129, and is distributed into each of the pressure chambers 128. The ink passes from the pressure chambers 128 to the nozzles 122 via the through holes 132. (Refer to FIG. 26.)

As shown in FIG. 26, the piezoelectric actuator 130 is structured wherein a plurality of piezoelectric sheets 136 are laminated one above the other. As in the case disclosed in Japanese Laid-Open Patent Publication No. 4-341851, narrow electrodes (not shown) are formed with respect each of the pressure chambers 128 on upper surfaces of the lowest piezoelectric sheet 136 and the odd piezoelectric sheets 136 counted upward from the lowest one. On upper surfaces of the even piezoelectric sheets 136 counted from the lowest one, common electrodes (not shown) are formed with respect to some pressure chambers 128. Surface electrodes 134, 135 are provided on the top surface of the piezoelectric actuator 130 along the edges of the long sides. The surface electrodes 134 are electrically connected to the each of the narrow electrodes and the surface electrodes 135 are electrically connected to the common electrodes. (Refer to FIG. 22.)

The piezoelectric actuator 130 is laminated to the cavity plate 120 in such a manner that each of the narrow electrodes in the piezoelectric actuator 130 is associated with each of the pressure chambers 128 in the cavity plate 120. As the flexible flat cable 140 is overlaid on an upper surface of the piezoelectric actuator 130, various wiring patterns (not shown) in the flexible flat cable 140 are electrically connected to the surface electrodes 134, 135.

With this structure, when voltage is applied between one of the narrow electrodes and one of the common electrodes in the piezoelectric actuator 130, the piezoelectric sheet 136 sandwiched between the narrow electrode and the common electrode deforms by piezoelectric effect in a direction where the sheets are laminated. By this deformation, the volume of the pressure chamber 128 corresponding to the narrow electrode is reduced, causing ink stored in the pressure chamber 128 to be ejected in a droplet from the associated nozzle 122 (FIG. 26), thereby performing printing.

The number of the piezoelectric ink jet heads 106 can be one to four. The cavity plate 120 may be made of ceramics in addition to metal. Further, the ink jet printer of the invention is driven by the piezoelectric actuator 130 in the shape of a plate, however, the ink jet printer of the invention may be driven by a piezoelectric actuator in any form. In addition, the ink jet printer may be structured wherein ink is ejected from the nozzles 122 by vibrating a plate covering the reverse side surface of the pressure chambers by static electricity.

Figure 27A:
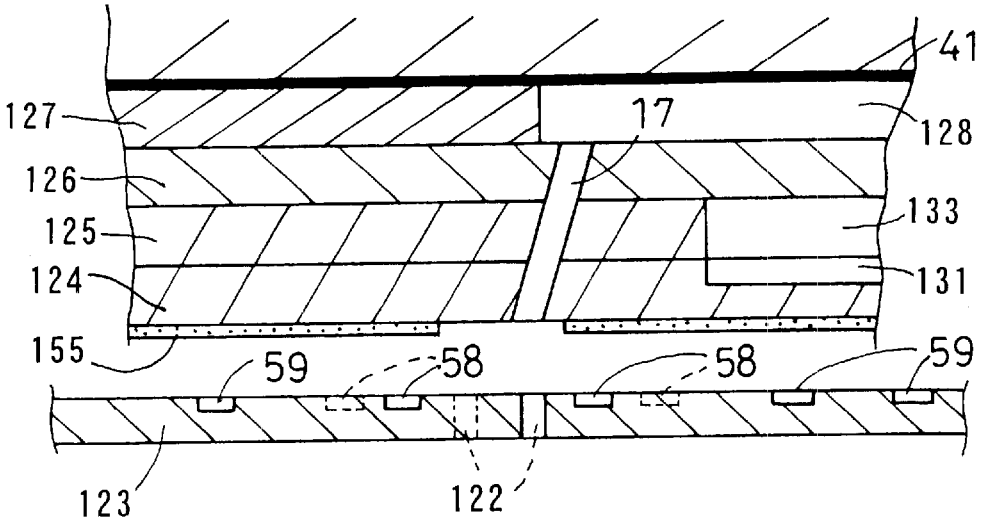
FIG. 27A is an enlarged sectional view of a bonding portion between the cavity plate and the nozzle plate according to a third embodiment.
Figure 27B:
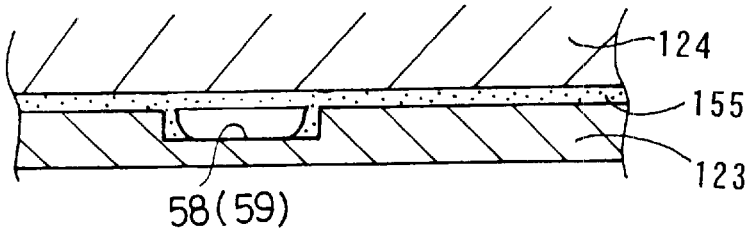
FIG. 27B is an enlarged sectional view of an agent-receiving portion according to the third embodiment.

In a third embodiment, the agent-receiving portions 58, 59 are formed on the back of the nozzle plate 123 (FIGS. 27 and 27B).

Figure 27C:
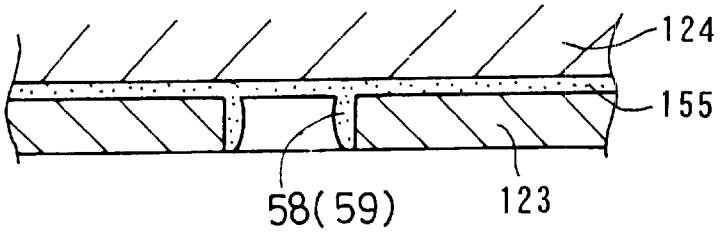
FIG. 27C is an enlarged sectional view of an agent-receiving portion according to a fourth embodiment.

In a forth embodiment, as shown in FIG. 27C, the agent-receiving portions 58, 59 are drilled through the nozzle plate 123.

In any case, the area where the adhesive 155 is applied is increased, thereby improving strength of adhesion between plates. The agent-receiving portions 58, 59 may be shaped in not only a circle but also other shapes such as a rectangle and an oval.

While the invention has been described with reference to the embodiments, it is to be understood that the invention is not restricted to the particular forms shown in the foregoing embodiments. Various modifications and alternations can be made thereto without departing from the scope of the invention.

What is claimed is:

1. An ink jet recording apparatus, comprising:

an ink jet head comprising:

a plurality of nozzles that eject ink onto a recorded medium;

a plurality of pressure chambers provided in association with the nozzles; and a plurality of pressure generating portions that apply pressure to the pressure chambers so as to allow ink to be ejected from the nozzles;

a body frame that communicates with an ink supply source and the ink jet head so as to supply the ink to the ink jet head;

a cover plate that has at least one window in a shape so as to enclose the nozzles, the cover plate being fixed to cover the ink jet head and fixed to the body frame;

at least one inlet that communicates with an internal space formed between the body frame and the cover plate; and at least one outlet that communicates with the internal space;

wherein a filling material is supplied from the at least one inlet and ejected to the at least one outlet.

2. The ink jet recording apparatus according to claim 1, wherein the body frame has the at least one inlet and the at least one outlet.

3. The ink jet recording apparatus according to claim 2, wherein the at least one outlet is provided at an end portion of the internal space substantially the farthest away from the at least one inlet.

4. The ink jet recording apparatus according to claim 3, wherein the body frame includes a plurality of outlets between the at least one inlet and the at least one outlet.

5. The ink jet recording apparatus according to claim 4, wherein the plurality of outlets are provided through the body frame and spaced with a specified distance, and the outlets have at least two different internal diameters according to where they are located.

6. The ink jet recording apparatus according to claim 5, wherein the plurality of outlets have different internal diameters according to a distance from the at least one inlet, the internal diameters increasing with the distance.

7. The ink jet recording apparatus according to claim 2, wherein the ink jet head is accommodated in the internal space formed between the body frame and the cover plate, and one surface of the ink jet head is covered with the cover plate and the other surface of the ink jet head is received by the body frame.

8. The ink jet recording apparatus according to claim 7, wherein the body frame has, on its ink jet head-receiving surface, a channel that guides the filling material supplied from the at least one inlet, and the filling material is spread between opposed surfaces of the body frame and the ink jet head and fills the at least one outlet.

9. The ink jet recording apparatus according to claim 2, wherein the ink jet head is bonded to the body frame while an ink passage formed in the body frame to communicate with the ink supply source is connected to an ink supply hole formed in the ink jet head, and the at least one inlet is formed near the ink passage such that a connecting portion between the ink passage and the ink supply hole is sealed with the filling material.

10. The ink jet recording apparatus according to claim 1, wherein the body frame and the cover plate are sealed by a sealer.

11. The ink jet recording apparatus according to claim 10, wherein the cover plate comprises a bottom wall abutting the ink jet head, side walls standing perpendicularly to the bottom wall, and a flange protruding externally around along edges of the side walls on an opposite side of the bottomwall, the body frame has channels into which the side walls and the flange of the cover plates are inserted, and the channels are filled with the sealer.

12. The ink jet recording apparatus according to claim 11, wherein the cover plate has a substantially box shape and an upper open structure.

13. The ink jet recording apparatus according to claim 11, wherein the ink jet head comprises a cavity plate having the pressure chambers and a nozzle plate having the nozzles, the nozzle plate is smaller than the cavity plate in size and adhered to the cavity plate, and the cover plate has the at least one window that accommodates the nozzle plate at the bottom wall, wherein the bottom wall is thicker than the nozzle plate, and the cavity plate is adhered to the cover plate around the nozzle plate.

14. The ink jet recording apparatus according to claim 1, wherein the filling material is silicon resin.

15. An ink jet recording apparatus comprising:

at least one ink jet head having a plurality of nozzles that eject ink onto a recording medium;

a cover plate having at least one window that encloses the nozzles, the cover plate being fixed onto the at least one ink jet head so as to enclose the nozzles with the window;

a body frame having a bottom plate that is fixed to the at least one ink jet head and the cover plate;

a plurality of holes provided through the bottom plate of the body frame, to correspond with the at least one ink jet head and the cover plate when the body frame and the cover plate sandwich the at least one ink jet head therebetween; and at least one blocking groove that is provided on one of a surface of the at least one ink jet head which is adhered to the cover plate or a surface of the cover plate which is adhered to the ink jet head, the at least one blocking groove being provided between an outside edge around the at least one window and at least one side of the at least one ink jet head;

wherein the at least one ink jet head and the cover plate are adhered to the bottom plate of the body frame by a first adhesive supplied from the holes provided through the bottom plate, and the at least one ink jet head is adhered to the cover plate by a second adhesive applied to an area disposed between the window and the blocking groove.

16. The ink jet recording apparatus according to claim 15, wherein the nozzles are arranged in a row, and the at least one blocking groove extends parallel along the row.

17. The ink jet recording apparatus according to claim 16, wherein the at least one blocking groove comprises a plurality of blocking grooves having first ends and second ends.

18. The ink jet recording apparatus according to claim 17, wherein the blocking grooves have bending portions at both ends toward the nozzles.

19. The ink jet recording apparatus according to claim 18, wherein the apparatus includes four ink jet heads connected in parallel, the cover plate has four windows, and the holes are disposed so as to face a connected portion and outer sides of the connected ink jet heads, the holes facing the connected portion of the ink jet heads are wider than the holes facing the outer sides of the ink jet heads, wherein the ink jet heads are fixed at the connected portion of the ink jet heads and the outer sides of the ink jet heads, so as to fix the four ink jet heads to the body frame at once.

20. The ink jet recording apparatus according to claim 15, wherein each of the ink jet heads has a first plate having the nozzles and a second plate having ink channels, and the first plate is adhered to the second plate so as to connect the nozzles to the ink channels.

21. The ink jet recording apparatus according to claim 20, wherein the first plate has agent-receiving portions in an outer area that encloses the nozzles, the outer area has a first area near the row of the nozzles and a second area outside the first area, and the agent-receiving portions are disposed more densely in the first area than in the second area.

22. The ink jet recording apparatus according to claim 21, wherein the agent-receiving portions pass through the first plate.

23. The ink jet recording apparatus according to claim 21, wherein the agent-receiving portions are recessed in the first plate.

24. The ink jet recording apparatus according to claim 20, wherein the second plate has agent-receiving portions recessed in an outer area that encloses the nozzles, the outer area has a first area near the row of the nozzles and a second area outside the first area, and the agent-receiving portions are disposed more densely in the first area than in the second area.

25. A method of producing an ink jet recording apparatus comprising the steps of:

applying an adhesive to a front side surface of an ink jet head having a plurality of nozzles arranged in a row or a rear side surface of a cover plate having a window that encloses the nozzles at a place near the nozzles in an area between the nozzles and a blocking groove formed on the front surface of the ink jet head or the rear side surface of the cover plate;

overlaying the ink jet head on the cover plate by the adhesive at a determined position;

overlaying the ink jet head and the cover plate on a bottom plate of a body frame; and supplying an adhesive from holes provided through the bottom plate of the body frame to the front side surface of the ink jet head and the rear side surface of the cover plate so as to fix the ink jet head, the cover plate, and the bottom plate.

26. The method of producing an ink jet recording apparatus according to claim 25, further comprising the step of filling a filling material into an internal space formed between the body frame and the cover plate where the ink jet head is accommodated from an inlet communicating with the internal space until the filling material is discharged from an outlet communicating with an end portion of the internal space, which is the farthest away from the inlet.

27. The method of producing an ink jet recording apparatus according to claim 26, further comprising the step of filling a juncture between the body frame and the cover plate by a sealer.

28. The method of producing an ink jet recording apparatus, according to claim 26 wherein the inlet and the outlet are formed in the body frame.

* * * * *